US006252571B1

(12) United States Patent
Nomura et al.

(10) Patent No.: US 6,252,571 B1
(45) **Date of Patent: *Jun. 26, 2001**

(54) LIQUID CRYSTAL DISPLAY DEVICE AND ITS DRIVE METHOD AND THE DRIVE CIRCUIT AND POWER SUPPLY CIRCUIT DEVICE USED THEREIN

(75) Inventors: Hiroaki Nomura; Akira Inoue, both of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/765,894

(22) PCT Filed: Sep. 14, 1995

(86) PCT No.: PCT/JP95/01835

§ 371 Date: Jan. 7, 1997

§ 102(e) Date: Jan. 7, 1997

(87) PCT Pub. No.: WO96/36902

PCT Pub. Date: Nov. 21, 1996

(30) Foreign Application Priority Data

May 17, 1995 (JP) ..... 7-118131

(51) Int. Cl.[7] ..... G09G 3/36

(52) U.S. Cl. ..... 345/95; 345/208; 345/210

(58) Field of Search ..... 345/94, 95, 96, 345/97, 208, 209, 210

(56) References Cited

U.S. PATENT DOCUMENTS 3,837,730 9/1974 Hatfield et al. ..... 349/34
4,239,345 12/1980 Berreman et al. ..... 349/179

(List continued on next page.)

FOREIGN PATENT DOCUMENTS 1010136 5/1977 (CA) .

0 155 033 9/1985 (EP) .

(List continued on next page.)

OTHER PUBLICATIONS

M. Schadt and W. Helfrich entitled, "Voltage–Dependent Optical Activity Of A Twisting Nematic Liquid Crystal", Applied Physics Letters, vol. 18(4), pp. 127–128 (1971).

(List continued on next page.)

*Primary Examiner*—Vijay Shankar
*Assistant Examiner*—Vanel Frenel
(74) *Attorney, Agent, or Firm*—Mark P. Watson

(57) ABSTRACT

Liquid crystal display device and its drive method that applies the voltage of the difference of a scanning signal and a data signal having at least a reset period, a selection period and a non-selection period in one frame on a chiral nematic liquid crystal having at least two stable states. A total of eight voltage levels made up of a plurality of levels (V1, V2, V3, V4) of a first group on the low voltage side and a plurality of levels (V5, V6, V7, V8) of a second group on the high voltage side are provided. The voltage levels of scanning signal Yi and data signal Xj are alternated between the first group and second group every mH (where, m is an integer that is 2 or greater and H≠1 frame period), which is an integral multiple of the unit time (1H) equivalent to the selection period T2 of scanning signal Yi. When the data signal (Xj) is a voltage level of the first group, the voltage level of the reset period (T1) in the scanning signal (Yi) is selected from the second group, and when the data signal (Xj) is a voltage level of the second group, the voltage level of the reset period (T1) in the scanning signal (Yi) is selected from the first group. When the data signal (Xj) is a voltage level of the first group, the voltage levels of the selection period (T3) and non-selection period (T4) in the scanning signal (Yi) are each selected from the same first group, and when the data signal is a voltage level of the second group, the voltage levels of the selection period (T3) and non-selection period (T4) in the scanning signal (Yi) are each selected from the same second group. By this means, the polarity of the voltage applied to the liquid crystal is reversed every mH.

29 Claims, 16 Drawing Sheets

U.S. PATENT DOCUMENTS

| | | | | |
|---|---|---|---|---|
| 4,333,708 | | 6/1982 | Boyd et al. | 349/129 |
| 4,367,924 | | 1/1983 | Clark et al. | 349/37 |
| 4,411,496 | | 10/1983 | Nonomura et al. | 349/34 |
| 4,505,548 | | 3/1985 | Berreman et al. | 349/179 |
| 4,529,271 | | 7/1985 | Berreman et al. | 349/34 |
| 4,566,758 | | 1/1986 | Bos | 348/128 |
| 4,582,396 | | 4/1986 | Bos et al. | 349/180 |
| 4,601,542 | | 7/1986 | Meyer | 349/128 |
| 4,601,543 | | 7/1986 | Boyd et al. | 349/23 |
| 4,601,544 | | 7/1986 | Cheng et al. | 349/128 |
| 4,634,229 | | 1/1987 | Amstutz et al. | 349/101 |
| 4,664,483 | | 5/1987 | Van Sprang et al. | 349/33 |
| 4,701,026 | | 10/1987 | Yazaki et al. | 345/97 |
| 4,717,243 | | 1/1988 | Boyd et al. | 345/94 |
| 4,770,500 | | 9/1988 | Kalmanash et al. | 349/80 |
| 4,850,676 | | 7/1989 | Yazaki et al. | 345/97 |
| 5,095,376 | | 3/1992 | Umeda et al. | 349/3 |
| 5,189,535 | | 2/1993 | Mochizuki et al. | 349/33 |
| 5,196,738 | * | 3/1993 | Takahara et al. | 307/296.1 |
| 5,251,048 | | 10/1993 | Doane et al. | 359/51 |
| 5,287,205 | | 2/1994 | Yamazaki et al. | 349/174 |
| 5,337,070 | * | 8/1994 | Kitajima et al. | 345/211 |
| 5,343,217 | | 8/1994 | Kim | 345/95 |
| 5,404,150 | | 4/1995 | Murata | 345/95 |
| 5,488,499 | | 1/1996 | Tanaka et al. | 349/177 |
| 5,563,427 | | 10/1996 | Yudasaka et al. | 257/72 |
| 5,594,464 | | 1/1997 | Tanaka et al. | 345/94 |
| 5,684,503 | | 11/1997 | Nomura et al. | 345/97 |
| 5,835,075 | | 11/1998 | Nomura et al. | 345/97 |
| 5,900,852 | | 5/1999 | Tanaka et al. | 345/87 |

FOREIGN PATENT DOCUMENTS

| | | |
|---|---|---|
| 0 197 743 | 10/1986 | (EP) . |
| 0 285 402 | 10/1988 | (EP) . |
| 0 300 755 | 1/1989 | (EP) . |
| 0 379 326 | 7/1990 | (EP) . |
| 0 422 904 | 4/1991 | (EP) . |
| 0 479 530 | 4/1992 | (EP) . |
| 0 536 975 | 4/1993 | (EP) . |
| 0 569 029 | 11/1993 | (EP) . |
| 0 579 247 | 1/1994 | (EP) . |
| 0 613 116 | 8/1994 | (EP) . |
| 2 117 157 | 10/1983 | (GB) . |
| 2 233 106 | 1/1991 | (GB) . |
| 59-58420 | 4/1984 | (JP) . |
| 59-219720 | 12/1984 | (JP) . |
| 60-196728 | 10/1985 | (JP) . |
| 63-68819 | 3/1988 | (JP) . |
| 63-81328 | 4/1988 | (JP) . |
| 1-216323 | 8/1989 | (JP) . |
| 1-51818 | 11/1989 | (JP) . |
| 3-26368 | 4/1990 | (JP) . |
| 3-177817 | 8/1991 | (JP) . |
| 5-37057 | 2/1993 | (JP) . |
| 6-230751 | 8/1994 | (JP) . |
| 7-175041 | 7/1995 | (JP) . |

OTHER PUBLICATIONS

T.J. Scheffer and J. Nehring entitled, "A New, Highly Multiplexable Liquid Crystal Display", Applied Physics Letters, vol. 45(10), pp. 1021–1023 (Nov. 15, 1984).

Robert B. Meyer and R.N. Thurston entitled, "Discovery Of DC Switching Of A Bistable Boundary Layer Liquid Crystal Display", Applied Physics Letters, vol. 43(4), pp. 342–344, (Aug. 15, 1983).

IEEE Transcations on Electron Devices, vol. 36, on.9–I, Sep. 1989 New York, US, pp. 1895–1899, Ferroelectric Liquid–Crystal Video Display, W.J.A.M. Hartmann.

D.W. Berreman entitled, "Numerical Modeling Of Twisted Nematic Devices", Bell Laboratories, New Jersey; Phil. Trans. R. Soc. Lond. A, pp. 203–216, 1983.

* cited by examiner

FIG.-2A
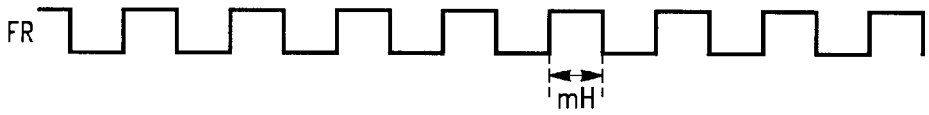
FIG.-2B
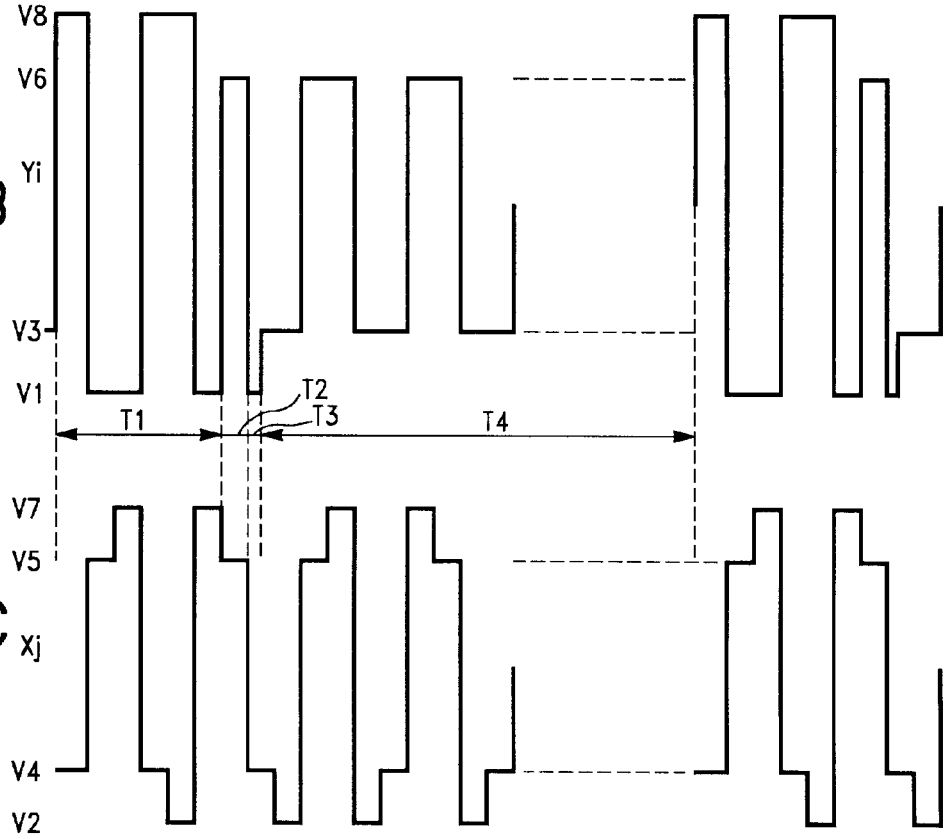
FIG.-2C
FIG.-2D
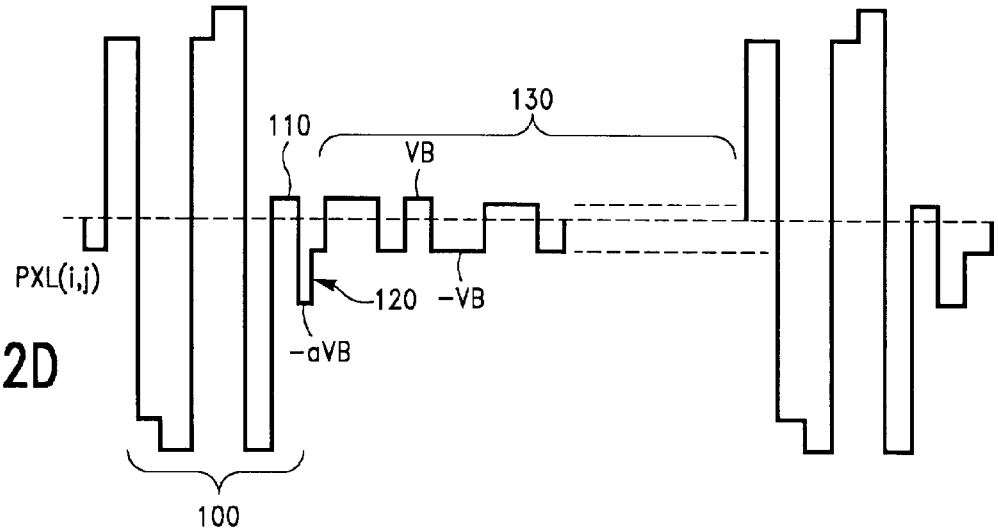

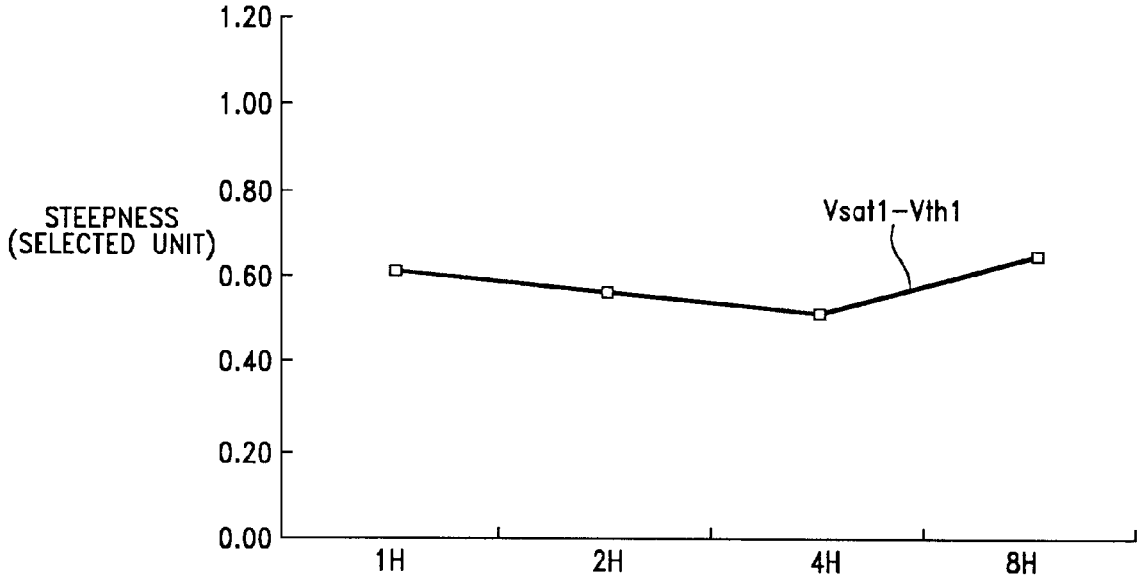
FIG.−19
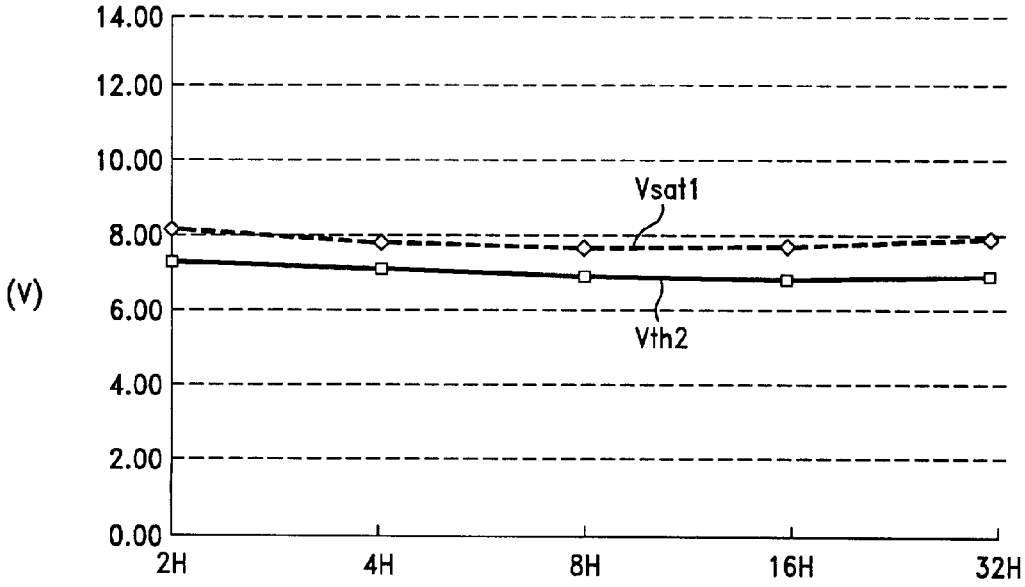
FIG.−20

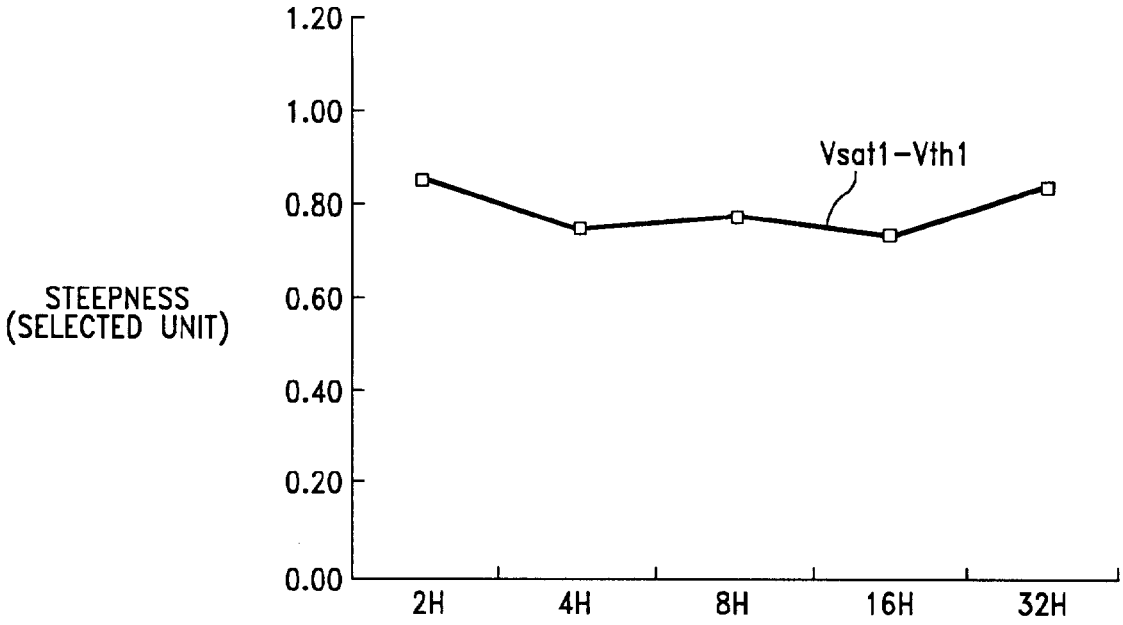
FIG.−21
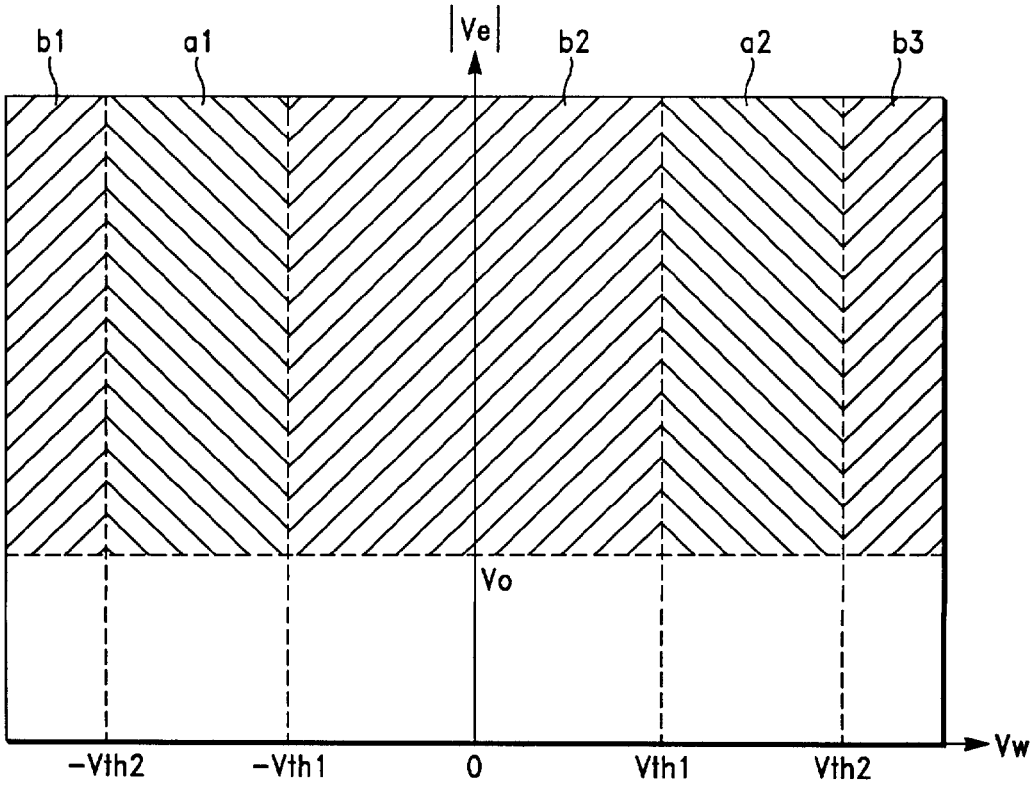
FIG.−22

| TRUTH TABLE FOR Y DRIVER OUTPUT | | | | |
|---|---|---|---|---|
| RESET R | SELECT S | ALTERNATING CURRENT FR | YOUT1 | YOUT2 |
| L | L | L | V6 | V7 |
| L | L | H | V3 | V2 |
| L | H | L | V8 | V5 |
| L | H | H | V1 | V4 |
| H | L | L | V1 | V4 |
| H | L | H | V8 | V5 |
| H | H | * | * | * |

*DON'T CARE

FIG.—24

| TRUTH TABLE FOR X DRIVER OUTPUT | | | |
|---|---|---|---|
| DATA | FR | XOUT1 | XOUT2 |
| L | L | V7 | V6 |
| L | H | V2 | V3 |
| H | L | V5 | V8 |
| H | H | V4 | V1 |

FIG.—25

LIQUID CRYSTAL DISPLAY DEVICE AND ITS DRIVE METHOD AND THE DRIVE CIRCUIT AND POWER SUPPLY CIRCUIT DEVICE USED THEREIN

FIELD OF THE INVENTION

This invention relates to a bistable liquid crystal display device that uses a chiral nematic liquid crystal and has a memory effect and its drive method and the drive circuit used therein. This invention also relates to a liquid crystal display device that sets a total of eight or more voltage levels suited to driving chiral nematic liquid crystal and the power supply circuit device used therein.

BACKGROUND OF THE INVENTION

A bistable liquid crystal display that uses chiral nematic liquid crystal is disclosed in Japanese Laid-Open Patent Application 1-51818, which describes the initial orientation condition, the two stable states, the method whereby the stable states are achieved, etc.

However, the description in the aforementioned Japanese Laid-Open Patent Application 1-51818 notes only the action or phenomenon of two stable states and does not disclose any means offered for the practical application as a display member. Further, the above publication contains no description of a matrix display, which currently has the greatest potential for application as a display member, or any disclosure of a drive method.

In Japanese Laid-Open Patent Application 6-230751, which we have submitted, we proposed a method that controls back-flow which occurs in a liquid crystal cell for improved practical application. This method first provides a period wherein a Frederick's transition is generated by applying a high voltage for about 1 ms, and then it either creates a 0-degree uniform state by immediately applying a constant voltage pulse following the Frederick's transition voltage whose polarity is reversed from or the same as the previous pulse and whose threshold value is greater, or it realizes a 360-degree-twisted state by similarly providing a pulse period with a lower threshold value immediately following the Frederick's transition voltage. In this method, the writing time per line of the matrix display is 400 $\mu$s, thus requiring a total of more than 160 ms (6.25 Hz) to write more than 400 lines, which results in flickering of the display and therefore presents a problem in practical application.

The inventors submitted in Japanese Laid-Open Patent Application 5-37057 a means of further improving the writing time. This, as shown in FIG. 2 and FIG. 4 of such application, provides a delay time after the reset pulse that generates the Frederick's transition and then applies an ON or OFF selection signal. By doing this, a writing time several times faster, e.g., 50 $\mu$s, than previously can be realized.

However, these drive methods require that a large reset voltage exceeding 20 V, an OFF voltage of 1 to 3 V for achieving two stable states and a selection voltage ranging from an ON voltage of several volts to 6 or 7 volts all efficiently coexist on the circuitry and that alternating current be used to achieve a longer liquid crystal life.

FIG. 23 of this application shows a 7-level drive method that creates a drive waveform for bistable display in accordance with the voltage averaging method. FIG. 23A is the waveform of the scanning signal, wherein Vr, which exceeds 20 V, is applied in reset period T1, ±Vs is applied in selection period T3, which comes after delay period T2, and the remaining non-selection period T4 is zero potential. The data signal, however, is in phase with the selection pulse of amplitude ±Vd shown in 23B of the same figure and switches display ON and OFF by applying a negative-phase AC pulse. Also, the voltage of the difference signal, like that shown in FIG. 23C, of the scan signal and the data signal is applied to the liquid crystal.

Here, since the bias voltage Vd need only be about 1 V, a large voltage difference occurs between the scanning signal waveform and the data signal waveform. Particularly since a voltage difference close to 20 V occurs between Vr and Vs in the scanning signal waveform, this is not desirable in a circuit configuration.

Since the ratio between the scanning voltage and the ON/OFF signal voltage during matrix drive in a bistable liquid crystal display is greatly unbalanced, this unbalance may become a major obstacle to configuring a specific drive circuit or configuring the circuit as an IC.

This is not that extreme even in the voltage-averaging drive method of prior art matrix type liquid crystal display elements, but based on similar conditions a six-level method was proposed (*Liquid Crystal Device Handbook,* Nikkan Kogyo, p. 401). However, though this is effective in balancing the drive voltages of the scanning waveform and the signal waveform and increasing the ratio of the ON voltage and the bias voltage, when a reset voltage with a large voltage difference like that in the present invention is also applied, it is impossible to apply it as is to drive a chiral nematic liquid crystal, which is an object of the present invention.

Since the number of levels of the drive voltage is large in the above method, adjustment of the optimum drive voltage becomes extremely difficult and presents a problem in practical application.

Further, since the threshold voltage and saturation voltage of the bistable liquid crystal are temperature dependent and fluctuate inside the liquid crystal panel, it was shown that it would be difficult to achieve a stable display characteristic.

A purpose of this invention is to offer a liquid crystal display device and its drive method and the drive circuit used therein which are capable of not generating a large voltage difference in the scanning signal waveform and the data signal waveform while still improving the display characteristic.

Another purpose of the invention is to offer a liquid crystal display device and its power supply circuit device capable of accurately generating a plurality of voltage levels greater than eight levels and also easily adjusting a plurality of levels by an easy operation.

SUMMARY OF THE INVENTION

This invention is a drive method for a liquid crystal display device that applies the voltage of the difference of a data signal and a scanning signal having at least a reset period, a selection period and a non-selection period in one frame on a chiral nematic liquid crystal having at least two stable states, wherein a total of eight or more voltage levels made up of a plurality of levels of a first group on the low voltage side and a plurality of levels of a second group on the high voltage side are provided, the voltage levels of the scanning signal and the data signal are alternated between the first group and second group every mH (where, m is an integer that is 2 or greater and mH≠1 frame period), which is an integral multiple of the unit time (1H) equivalent to the selection period of the scanning signal, when the data signal is a voltage level of the first group, the voltage level of the reset period in the scanning signal is selected from the second group, and when the data signal is a voltage level of the second group, the voltage level of the reset period in the scanning signal is selected from the first group, when the data signal is a voltage level of the first group, the voltage levels of the selection period and non-selection period in the scanning signal are each selected from the same first group, and when the data signal is a voltage level of the second group, the voltage levels of the selection period and non-selection period in the scanning signal are each selected from the same second group, and the polarity of the voltage applied to the liquid crystal is reversed every mH.

The liquid crystal display device related to the method of this invention comprises, a liquid crystal panel wherein a chiral nematic liquid crystal having at least two stable states is infused between a first substrate whereon a plurality of scanning electrodes are formed and a second substrate whereon a plurality of data electrodes are formed, a scanning electrode drive circuit that outputs a scanning signal having at least a reset period, a selection period and a non-selection period in one frame to each of the scanning electrodes, a data electrode drive circuit that outputs a data signal to each of the data electrodes, and a power supply circuit that outputs the eight or more voltage levels comprising a plurality of levels of a first group on the low-voltage side and a plurality of levels of a second group on the high-voltage side as the potentials of the scanning signal and the data signal.

Further, the scanning electrode drive circuit and the data electrode drive circuit set the various voltage levels for implementing the method of this invention.

Also, the scanning electrode drive circuit and the data electrode drive circuit which set the various voltage levels for implementing the method of this invention are defined in the drive circuit for the liquid crystal display device related to this invention. This drive circuit can be configured as a circuit external to the liquid crystal panel as well as being formed on the liquid crystal display substrate.

According to the invention described above, by selecting the voltage levels from the first group on the low-voltage side and the second group on the high voltage side as described above, a large reset voltage with an absolute value exceeding 20 V, for example, and a non-selection voltage around 1 V, for example, can be applied to the liquid crystal as the voltage of the difference signal of the scanning signal and the data signal without generating a large difference between their voltage amplitudes. This is advantageous when configuring the drive circuit and particularly when configuring it as an integrated circuit.

The reason for reversing the polarity of the voltage applied to the liquid crystal every mH is as follows. The inventors discovered that change in the voltage difference between the saturation voltage Vsat and the threshold voltage Vth of the chiral nematic liquid crystal is dependent on the value m determined by the reversal time (see FIG. 17 to FIG. 21). As disclosed (Japanese Laid-Open Patent Application 5-352493) prior to application by this assignee, compared to when reversal every 1H is employed; that is, when m=1 is employed, it is possible in this invention to select a value for m that determines the reversal time from an area that makes the voltage difference small.

The absolute value of the ON voltage applied to the chiral nematic liquid crystal during the selection period must be set larger than the absolute value of the saturation voltage Vsat of the chiral nematic liquid crystal. The absolute value of the OFF voltage applied to the chiral nematic liquid crystal during the selection period, however, must be set smaller than the absolute value of the threshold voltage Vth of the chiral nematic liquid crystal. Here, the saturation voltage and threshold voltage change with the ambient temperature and other environmental conditions (see FIG. 16). When the saturation voltages and the threshold voltages are compared for each pixel in the liquid crystal panel, however, they are unbalanced in the liquid crystal panel. Therefore, since the voltage difference of the saturation voltage Vs and threshold voltage Vth also changes depending on environmental conditions or is unbalanced in the liquid crystal panel, the pixels may not switch on or off in a worst-case condition depending on the settings for the ON voltage and the OFF voltage. If the absolute value of the voltage difference between the saturation voltage Vsat and the threshold voltage Vth of the chiral nematic liquid crystal can be made small, the allowable margin of the ON and OFF voltages can be made relatively large. As a result, the adverse effect of the voltage difference due to its dependence on environmental conditions or location in the liquid crystal panel can be reduced, thus improving the display characteristic.

In other words, by making the absolute value of the voltage difference between the saturation voltage Vsat and the threshold voltage Vth of the chiral nematic liquid crystal small, the absolute value of the ON voltage applied to all of the pixels of the chiral nematic liquid crystal can be set larger than the absolute value of the saturation voltage Vsat of the chiral nematic liquid crystal by at least an allowable margin, and the absolute value of the OFF voltage applied to all of the pixels of the chiral nematic liquid crystal can be set smaller than the absolute value of the threshold voltage Vth of the chiral nematic liquid crystal within an allowable margin.

In the above drive method, it is desirable that a delay period be provided between the reset period and the selection period. In this case, the voltage level in the delay period of the scanning signal is set to the same level as the voltage level of the non-selection period.

By this means, the selection period in the scanning signal, i.e., writing time, can be shortened.

The above drive method is ideal for driving a chiral nematic liquid crystal using a total of eight voltage levels. Drive of this chiral nematic liquid crystal requiring a total of 10 voltage levels is described below.

First, the data signal must be set to a data voltage level that includes the voltage level of either the ON voltage level or the OFF voltage level in each selection period. The four voltage levels for application to the liquid crystal, i.e., positive and negative ON selection voltages and positive and negative OFF selection voltages must be set as the data voltage levels of this data signal.

Next, the scanning signal must be set to the reset voltage level in the reset period, the selection voltage level in the selection period and the non-selection voltage level in the non-selection period. Two voltage levels are required as reset voltage levels for applying both positive and negative reset voltages on the liquid crystal in the reset period. Two voltage levels are required as selection voltage levels for applying both positive and negative selection voltages on the liquid crystal in the selection period. Two voltage levels are required as non-selection voltage levels to give a bias voltage level to the non-selection period.

As described above, a minimum of 10 levels is required, but by using the two reset voltage levels and two selection voltage levels in common, the chiral nematic liquid crystal can be driven using a total of eight voltage levels.

It is desirable to configure these eight voltage levels from the four levels of the first group on the low-voltage side (V1, V2, V3, V4: V1<V2<V3<V4) and from the four levels of the second group on the high-voltage side (V5, V6, V7, V8: V4<V5<V6<V7<V8).

In an example of a drive method using these eight voltage levels as shown in FIG. 2, for example, the scning signal can have a waveform with voltage levels V1 and V8 in the reset period and can have a waveform with voltage levels V1 or V8 in the selection period and voltage levels V3 and V6 in the non-selection period.

The data signal can have a waveform that includes a pulse wherein the peak value changes to voltage levels V2 and V4 and a pulse wherein the peak value changes to voltage levels V5 and V7. In this case, it is desirable that the relationship V4−V3=V3−V2=V7−V6=6−V8 be established. This is because a nearly equivalent non-selection voltage an be set in the non-selection period.

In another example of a drive method using a total of eight voltage levels as shown in FIG. 5, the scanning signal can have a waveform with voltage levels V4 and V5 in the reset period and can have a waveform with voltage levels V4 or V5 in the selection period and voltage levels V2 and V7 in the non-selection period.

The data signal can have a waveform that includes a pulse wherein the peak value changes to voltage levels V1 and V3 and a pulse wherein the peak value changes to voltage levels V6 and V8.

In this case, when the relationship V3−V2=V2−V1=V8−V7=V7−V6 is satisfied, a nearly equivalent non-selection voltage can be set in the non-selection period.

The value m that determines the reversal time in this invention can be set to a value whereby the value resulting from dividing the number of scanning lines of the display by m becomes an integer. It is also possible to set the value m that determines the reversal time in this invention to a value whereby the value resulting from dividing the number of scanning lines of the display by m does not become an integer. In the case of the latter, the mH reversal position can be naturally shifted so that the reversal position at each mH is in a different position between contiguous frames, thus making it possible to prevent the rounding of the waveform or crosstalk due to reversal from becoming pronounced.

According to another embodiment of the invention, it is possible to overlap reversal of frame units at reversal every mH (mH<1 frame period) described above. In this case, when the voltage at the start of the nth frame (n is an integer) is a voltage level of the first group, the start of the (n+1)th frame is a voltage level of the second group. When the voltage at the start of the nth frame is a voltage level of the second group, the start of the (n+1)th frame is a voltage level of the first group.

For example, when frame reversal is overlapped at the mH (mH<1 frame period) reversal shown in FIG. 2, the ON selection voltage level of the data signal is set to V4 of the first group and the OFF selection voltage level is set to V2 of the first group, and the reset voltage level at the start of the scanning signal is set to V8 and the selection voltage level is set to V1 in the nth frame (n is an integer) as shown in FIG. 6. In the following (n+1)th frame, the ON selection voltage level of the data signal is set to V8 of the second group and the OFF selection voltage level is set to V7 of the second group, and the reset voltage level at the start of the scanning signal is set to V1 and the selection voltage level is set to V8.

For example, when frame reversal is overlapped at the mH (mH<1 frame period) reversal shown in FIG. 5, the ON selection voltage level of the data signal is set to V1 of the first group and the OFF selection voltage level is set to V3 of the first group, and the reset voltage level at the start of the scanning signal is set to V5 and the selection voltage level is set to V4 in the nth frame (n is an integer) as shown in FIG. 7. In the following (n+1)th frame, the ON selection voltage level of the row electrode signal is set to V8 of the second group and the OFF selection voltage level is set to V6 of the second group, and the reset voltage level at the start of the data signal is set to V4 and the selection voltage level is set to V5.

When the eight voltage levels V1 to V8 are used, it is desirable that the voltage level difference between voltage level V4 of the first group and voltage level V8 of the second group be large. This is because the absolute value of the reset voltage applied to the liquid crystal in the reset period can be set large.

In yet another embodiment of the invention, the power supply circuit device of the liquid crystal drive device, which generates an even number of a total of 8 or more voltage levels (V1, V2, . . . , $V_{k-1}$, Vk; V1<V2<. . . <$V_{k-1}$<$V_k$), including ground voltage level V1, for applying the voltage of the difference signal of the scanning signal and the data signal to the liquid crystal, has means for generating a maximum voltage level $V_k$, means for generating a potential difference $V_B$, which becomes the reference for generating voltage levels V2 to $V_{k-1}$ not including maximum voltage level Vk and ground voltage level V1, calculation means for calculating and outputting voltage levels V2 to $V_{k-1}$ based on the potential difference $V_B$, and changing means for changing the value of the potential difference $V_B$ from outside or externally.

By doing this, it becomes possible to adjust each voltage level (V2, . . . , $V_{k-1}$), except the ground voltage level V1 and maximum voltage level $V_k$, simultaneously by changing potential difference $V_B$.

Here, it is desirable that the means that generates potential difference $V_B$ generate potential difference $V_B$ based on maximum voltage level $V_k$.

It is also desirable that the calculation means have a plurality of calculation circuits to which the voltage level $V_B$ is input and that calculate and output each of the voltage levels (V2, . . . , $V_{k/2}$) from among the plurality of levels (V1, V2, . . . , $V_{k/2}$), except the ground voltage level V1, of the first group on the low-voltage side of the eight or more voltage levels, and a plurality of subtraction circuits that generate each of the voltage levels ($V_{k-1}$, . . . , $V_{k/1}$), except maximum voltage level $V_k$, of the voltage levels (V2, $V_{k/2+2}$ . . . , Vk1, Vk) of the second group on the high voltage side by subtracting the respective outputs (V2, . . . , $V_{k/2}$) of the amplification means from the maximum voltage level $V_k$.

The power supply circuit described above is suited to a liquid crystal display device that uses chiral nematic liquid crystal having two stable states.

In each of the power supply circuit devices described above, it is desirable to set the reference potential difference level $V_B$ to $V_B$=|Von−Voff|/2 determined from Von and Voff of the data signal.

According to yet another embodiment of the invention, the power supply circuit device of the liquid crystal drive device that generates a total of eight or more voltage levels (V1, V2, . . . , $V_{k-1}$, $V_k$: V1<V2 . . .<$V_{k-1}$<$V_k$), including ground voltage level V1, for applying the voltage of the difference signal of the scanning signal and the data signal on the liquid crystal has, means for generating maximum voltage level $V_k$, (k-1) resistors (R1, R2, . . . , $R_{k-1}$) connected in series in order from one end to a line wherein the voltage at one end is the maximum voltage level $V_k$ and the other end is ground voltage level V1, (k-2) voltage output terminals connected between adjacent pairs of resistors and that output the voltage levels $V_{k-2}$ to V2 obtained by sequentially dropping the voltage via the resistors (R1, R2, . . . , $R_{k-2}$), and means for externally changing the resistance of one resistor from among the (k-1) resistors.

In this power supply circuit device, it is possible to simultaneously adjust each voltage level (V2 to $V_{k-1}$), not including ground voltage level V1 and maximum voltage level $V_k$ by changing the resistance of one resistor.

This power supply circuit device is also suited to a liquid crystal display device that uses chiral nematic liquid crystal having at least two stable states.

BRIEF EXPLANATION OF THE DRAWINGS

FIGS. 2A–2D are waveform diagrams showing an example of a drive waveform of the invention.

FIGS. 5A–6D are waveform diagrams showing another drive waveform of the invention.

FIGS. 6A–6D are waveform diagrams showing yet another drive waveform of the invention wherein frame reversal is added to the drive waveform of FIGS. 2A–2D.

FIG. 19 is a characteristic graph showing the relationship of the saturation value-threshold value to the reversal time mH prepared based on the data of FIG. 18.

FIG. 20 is a characteristic graph showing other experimental results of the relationship of the threshold value and saturation value of the chiral nematic liquid crystal to the reversal time mH.

FIG. 21 is a characteristic graph showing the relationship of the saturation value-threshold value to the reversal time mH prepared based on the data of FIG. 20.

FIG. 22 is a characteristic graph showing the threshold value as it relates to the selection voltage for driving the chiral nematic liquid crystal.

FIG. 24 is a truth table for determining the output voltage of the Y driver shown in FIG. 9.

FIG. 25 is a truth table for determining the output voltage of the X driver shown in FIG. 10.

PREFERRED EMBODIMENTS OF THE INVENTION

Figure 1A:
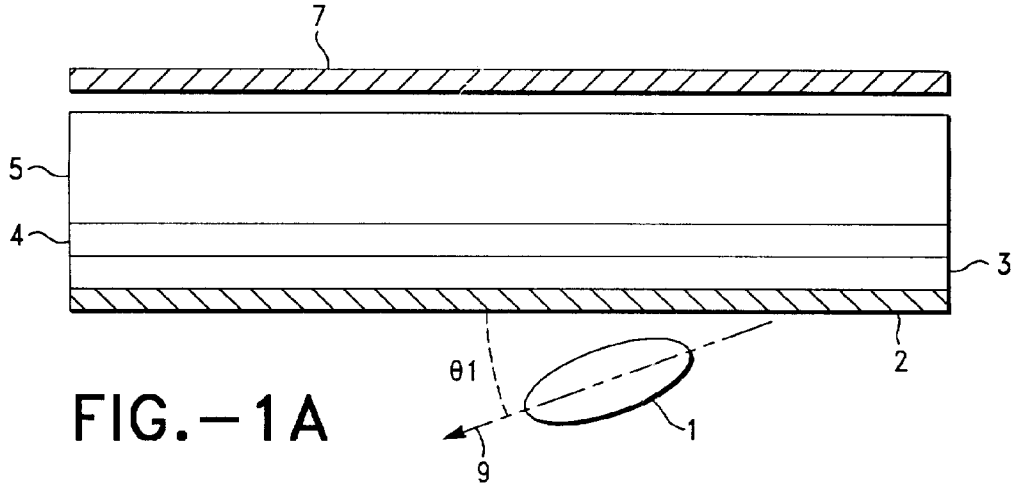
FIGS. 1A and 1B are general cross sections showing a liquid crystal cell that uses chiral nematic liquid crystal applicable to this invention.

The embodiments of the invention are explained below by referring to the drawings.

Structure of Liquid Crystal Cell

Figure 1B:
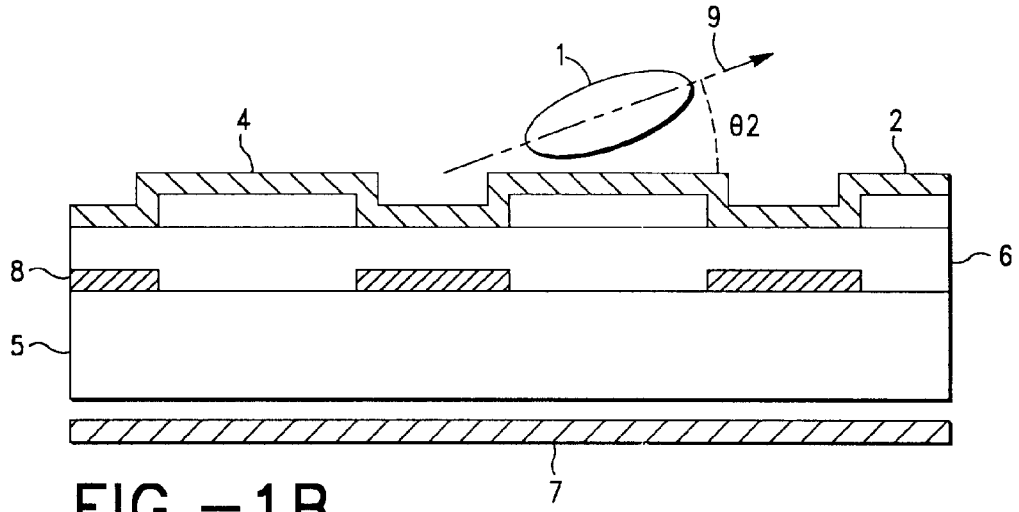

In the liquid crystal materials used in each of the embodiments described below, the helical pitch of the liquid crystal has been adjusted to 3 to 4 $\mu$m by adding an optically active material (e.g., S-811 manufactured by E. Merck) to nematic liquid crystal (e.g., ZLI-3329 manufactured by E. Merck). As shown in FIGS. 1A and 1B, a pattern of transparent electrodes 4 made from ITO is formed on upper and lower glass substrates 5,5, and a polyimide orientation film (e.g., SP-740 produced by Torei) 2 is applied to each of these. Also, the cell was configured bid rubbing each polyimide orientation film 2 in differing directions that form a prescribed angle $\phi$ (in this embodiment $\phi$=180 degrees) between them. A space is inserted between upper and lower glass substrates 5,5 to keep the gap between the substrates uniform; e.g., the substrate gap (cell interval) is made less than 2 $\mu$m. Therefore, the ratio liquid crystal layer thicknes&twist becomes 0.5±0.2.

When liquid crystal is infused in this cell, the pretilt angles $\phi$1 and $\phi$2 of liquid crystal molecules become several degrees, and the initial orientation is a 180-degree twisted state. This liquid crystal cell is sandwiched between two polarizing plates 7,7 whose polarizing directions shown in FIGS. 1A and 1B differ, thus forming the display member. In the figures, 3 is the insulation layer, 6 is the leveling layer, 8 is the mask layer for the interval between pixels, and 9 is the director vector of liquid crystal molecules 1.

Principle of Liquid Crystal Drive

FIGS. 2A–2D show an example of the drive waveform in AC drive of the liquid crystal wherein polarity reversal of the voltage applied to the liquid crystal is performed periodically. The timing for reversal is every mH at a multiple of m (where m is an integer that is 2 or greater) when selection period T3 of the scanning signal described below is 1H. However, mH≠1 frame period. This signal with a pulse duration of mH is shown in FIG. 2A as FR. FIG. 2B shows the waveform of the scanning signal supplied to the ith scanning signal line. FIG. 2C shows the waveform of the data signal supplied to the jth data signal line. FIG. D shows the waveform of the difference signal of the scanning signal in FIG. 2B and the data signal in FIG. 2C. The voltage of the difference signal in FIG. 2D is applied to the liquid crystal at the pixel (i, j) located at the intersection point of the ith scanning signal line and the jth data signal line.

The drive waveform shown in FIG. 2 includes reset period T1, delay period T2, selection period T3 and nonselection period T4. The period wherein each of these periods T1, T2, T3 and T4 are added is one frame period T.

In FIG. 2B, reset voltage (reset pulse) 100, which is greater than the threshold value for generating a Frederick's transition in the nematic liquid crystal, is applied is reset period T1. The peak value of this reset voltage 100 is set to ±25 V, for example, in this embodiment. Delay time T2 is provided to delay the timing whereby selection voltage (selection pulse) 120 is applied to the liquid crystal cell in selection period T3 after applying reset voltage 100 to the liquid crystal cell. In this embodiment, a voltage of ±1 V, for example, is applied to the liquid crystal cell as delay voltage 110 in this delay period T2. Selection voltage 120 applied to the liquid crystal cell in selection period T3 is a voltage selected using as a reference a critical value that generates one of the two stable states, e.g., 360-degree twisted state and 0-degree uniform state, of the nematic liquid crystal. If the peak value of selection voltage 120 is the 0- to ±1.5-V OFF voltage and this is used as selection voltage 120 in the case of the chiral nematic liquid crystal used in the first embodiment, a 360-degree twisted state is obtained. If an ON voltage of more than 2 V or less than −2 V or more desirably more than 3 V or less than −3 V is applied to the liquid crystal cell as selection voltage 120, however, a 0-degree uniform state is obtained. In nonselection period T4, a non-selection voltage 130 smaller than the absolute value of selection voltage 120 is applied to the liquid crystal cell, and therefore the liquid crystal state selected in selection period T3 is maintained.

Figure 3:
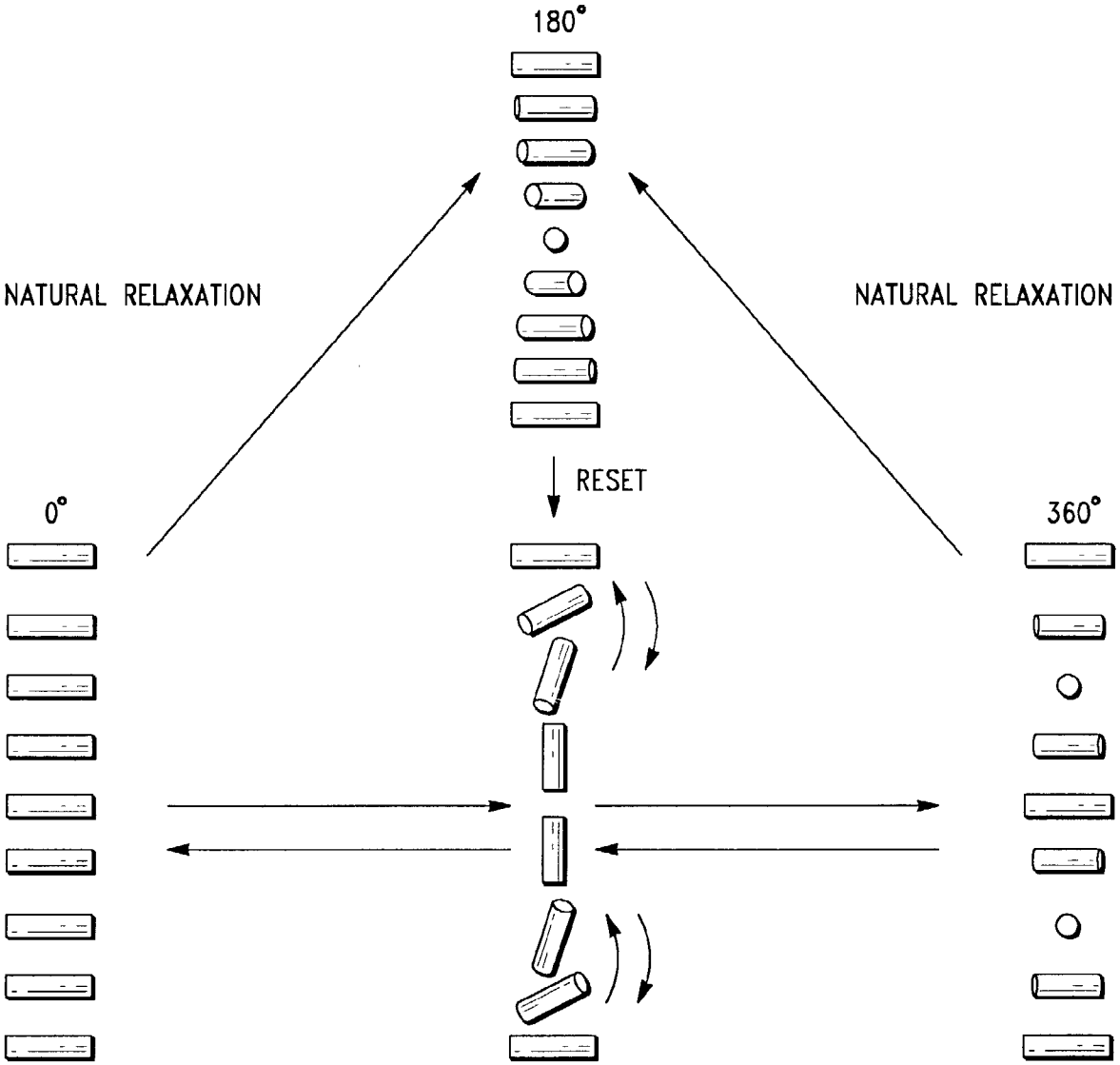
FIG. 3 is a diagram for explaining each state of the liquid crystal used in this invention.

FIG. 3 is a diagram for explaining each state of the liquid crystal.

This liquid crystal takes on a 180-degree twisted state in the initial state due to the rubbing treatment described above. When reset voltage 100 is applied to the liquid crystal in this initial state in reset period T1, a Frederick's transition is generated as shown in FIG. 3. When the ON voltage is then applied to the liquid crystal as selection voltage 120 in selection period T3, a 0-degree uniform state is obtained, and when the OFF voltage is applied, a 360-degree twisted state is obtained. Following this, both of the above states relax naturally to the initial state according to a certain time constant as shown in FIG. 3. Here, this time constant can be made sufficiently long as compared to the time required for display. Therefore, as long as non-selection voltage 130 applied in non-selection period T4 is kept at a sufficiently low voltage as compared to the voltage necessary to generate the Frederick's transition, the state set in selection period T3 can be nearly maintained during the interval until the next reset period T1. By this means, liquid crystal display becomes possible.

Figure 4:
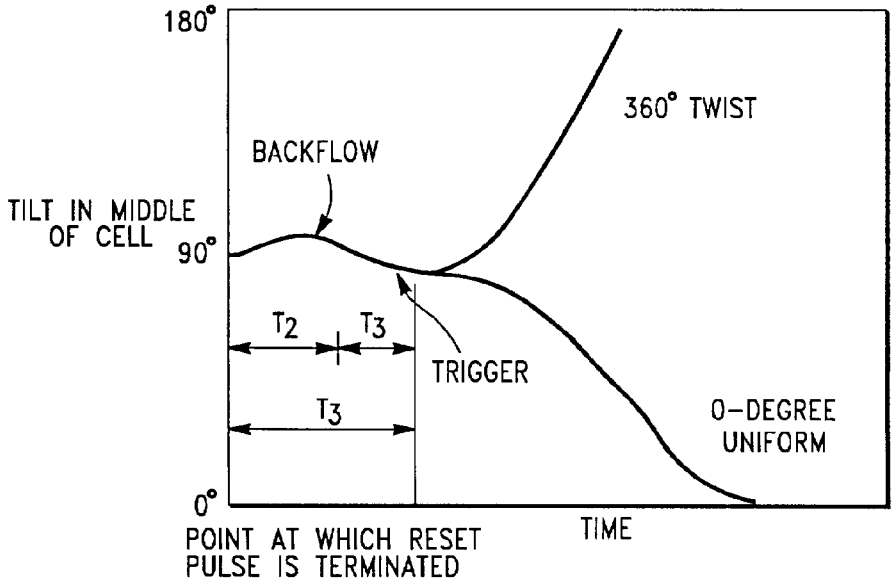
FIG. 4 is a diagram for explaining the behavior of the liquid crystal molecules used in this invention.

The reason for providing the delay time T3 is explained by referring to FIG. 4. FIG. 4 shows the results of a dynamic simulation indicating the behavior of the bistable liquid crystal used in this invention and the relationship between delay period T2 and selection period T3. Time is plotted on the horizontal axis against the tilt of the molecules in the middle of the liquid crystal cell on the vertical axis, and the starting point is the time at which reset pulse 100 is terminated.

According to this drawing, after the liquid crystal molecules are stood up vertically (homeolotropic state), some lean slightly toward the back (backflow) and then return and their tilt progresses towards 0 degree while others continue to tilt further toward 180 degrees. The former is a transition toward a uniform state and the latter is equivalent to a transition toward a 360-degree twisted state because a twist is added on top of this tilt change. Whether it be a transition toward a 0degree uniform state or a 360-degree twisted state as shown in this figure, the behavior is exactly the same immediately after reset pulse 100 is terminated in that they pass through the same process referred to as backflow of the liquid crystal. That is, whether the orientation state of the liquid crystal becomes 0 degree or 360 degrees is determined by how the trigger (arrow in FIG. 4) is applied after this backflow.

In the previous proposal of the assignee of the present invention, selection period T3 was set immediately after completion of reset period T1. In contrast to this, in the drive method of FIG. 2 related to the drive method of the first embodiment, delay period T2 is inserted between reset period T1 and selection period T3. By adjusting the duration of this delay period T2, it is possible to apply selection voltage 120 to this liquid crystal according to the timing the trigger should be applied after backflow of the liquid crystal occurs regardless of the length of selection period T3. Hence, even if the duration of selection period T3 should be greatly shortened to 50 $\mu$s, it is possible to perform ON/OFF switching of the liquid crystal.

When the pulse duration of the selection pulse, the delay time and the temperature are fixed, the critical value becomes as Vth1 and Vth2 shown in FIG. 22 as the pulse height of the selection pulse. At the intersecting surface of the absolute value of the voltage Ve of the reset pulse (vertical axis) and the voltage Vw of the selection pulse (horizontal axis) shown in FIG. 22, a1 and a2 indicate areas ($|Ve|>V0$ and $|Vth1|<|Vw|<|Vth2|$) where one of the metastable states (e.g., state with twist angle 0 degree) appears. Also, b1, b2 and b3 indicate areas ($|Ve|>V0$ and $|Vw|<|Vth1|$ or $|Ve|>V0$ and $|Vw|>|Vth2|$) where the other metastable state (e.g., state with twist angle 360 degrees) appears. Here, Vth1 and Vth2 are threshold values for the voltage of the selection pulse. In the following explanation, liquid crystal drive is performed using Vth1 as the threshold value.

Explanation of Drive Waveform in FIG. 2

Next is an explanation of the details of the drive waveform shown in FIG. 2. In this first embodiment, a total of eight voltage levels are used to drive the chiral nematic liquid crystal.

These eight voltage levels comprise the four levels (V1, V2, V3, V4; V1<V2<V3<V4) of the first group on the low-voltage side and the four levels (V5, V6, V7, V8; V4<V5<V6<V7<V8) of the second group on the high-voltage side.

Further, the scanning signal and the data signal are alternately set to a voltage level of the first group or the second group every mH (m=4 in FIG. 2).

Reset time T1 of the scanning signal is set to several tens of H (e.g., 1 to 2 ms). Since this reset period T1 is longer than reversal time mH, the voltage level is changed every mH during reset period T1. This results in the waveform in FIG. 2 wherein the voltage level of V1 or V8 is alternately repeated during reset period T1 of the scanning signal.

Next, delay time T2 of the scanning signal is greater than 1H and T2 is set to 2H in the case of FIG. 2. Since T2<mH, the voltage level becomes fixed in delay period T2 of the scanning signal, but it becomes a different voltage level according to the reversal every mR, and in this embodiment it becomes the voltage level of either V3 or V6. Here, in this embodiment, the last pulse duration of reset period T1 is 2H, and delay period T2 whose phase differs from this last pulse period is also 2H. Compared to reset period Ti, the reversal phase every mH of the scanning signal waveform changes 180 degrees after selection period T3.

Where selection period T3=1H<mH, the level becomes a fixed potential in selection period T3, but it becomes a different voltage level according to the reversal every mH, and in this embodiment it becomes the voltage level of either V1 or V8.

Where non-selection period T4>mH, the level becomes a voltage that differs every mH in one frame period. In this embodiment, a waveform having the voltage levels of V3 and V6 occurs in non-selection period T4 of the scanning signal. The data signal, as well, takes on a waveform whose voltage level changes every mH, and it becomes the ON voltage or OFF voltage depending on the voltage for writing to the liquid crystal. The ON voltage becomes V4 when the voltage of selection period T3 of the scanning signal is V1 and it becomes V5 when the voltage of selection period T3 is V8. The OFF voltage becomes V2 when the voltage of selection period T3 of the scanning signal is V1 and it becomes V7 when the voltage of selection period T3 is V8.

When a scanning signal and a data signal such as these are supplied to the respective scanning signal line and data signal line, the voltage of the difference signal shown in FIG. 2 is applied to the pixel (i, j) at the intersection of each line. That is, during reset period T1, relatively large voltage (V1−V7) or (V8−V2) is obtained as reset voltage 130. Moreover, the same relationship between the ON voltage, OFF voltage and bias voltage as in the prior art voltage averaging method is obtained.

Particularly, assuming that V4−V3=V3−V2=V7−V6=V6−V5, it is possible to set the voltage such that the bias voltage in non-selection period T4 is equal. To increase the ON voltage under this condition, the voltage difference between V1 and V2 and between V7 and V8 can be made large. Caution is required, however, since the bias voltage in non-selection period T4 also increases simultaneously. To make the reset voltage large, the potential difference between V4 and V5 can be further increased. Further, to adjust the length of the delay time after application of the reset voltage, the timing of the selection period can be shifted one 1H unit.

When the various voltages are set to V1=0 V, V2=1 V, V3=2 V and V4=3 V in the first group, VY=23 V, V6=24 V, V7=25 V and V8=26 V in the second group, V1=−13 V, V2=−12 V, V3=−11 V and V4=−10 V in the negative voltage first group, and V5=10 V, V6=11 V, V7=12 V and V8=13 V in the positive voltage second group, the reset voltage =25 V, ON voltage =3 V, OFF voltage =±1 V and bias voltage =±1 V can be obtained. By making the potential difference between voltage V4 of the first group and voltage V5 of the second group even larger, it is possible to realize reset voltages of 30 V and 40 V and a bias voltage of 1 V.

By means of the drive method in FIG. 2, the large voltages and small voltages required for drive of chiral nematic liquid crystal can be made to coexist and simple matrix drive can be efficiently realized. That is, by using the drive method of FIG. 2, a large reset voltage exceeding 20 V, a bias voltage (non-selection voltage) around 1 V and data ON and OFF voltages of several volts can all be achieved with a relatively small circuit voltage, and the voltage applied to the liquid crystal can be made an alternating current with an optimum reversal time. Since the respective drive voltages of the data signal and scanning signal approach each other, there is a greater degree of freedom in selection of circuit components when actually fabricating the drive circuit. Further, resolving this unbalance of the drive voltages is advantageous in integrating the drive circuitry.

In the above explanation, the reset voltage pair was (V1, V8), but (V2, V7), (V3, V6) or (V4, V5) can also be used. An example that uses the reset voltage pair (V4, V5) is described below using FIG. 6. Also, the drive method of FIG. 2 is also effective when there is no delay period T2.

Relationship Between mH Reversal and Display Characteristic

A drive that alternates the current every mE as employed in the drive method of FIG. 2 does not only contribute to increasing the life of the liquid crystal, it can also improve the display characteristic in a liquid crystal display device that uses chiral nematic liquid crystal. The reason is explained below.

Figure 16:
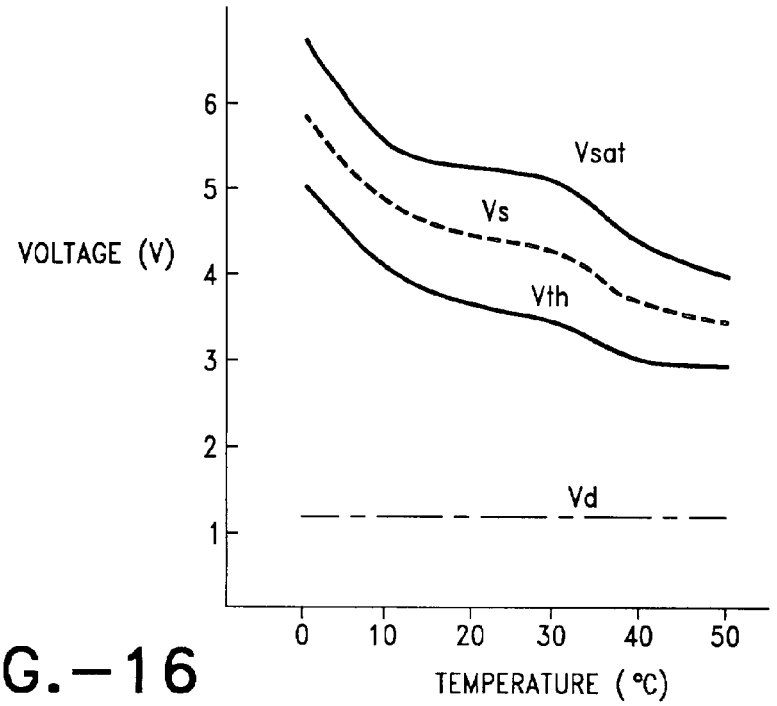
FIG. 16 is a characteristic graph showing the relationship of the threshold value and saturation value of the chiral nematic liquid crystal to temperature.

FIG. 16 is a characteristic graph showing the negative correlation of the threshold value Vth and saturation value Vsat of chiral nematic liquid crystal to temperature and shows that the threshold value Vth and saturation value Vsat are temperature dependent. Here, when Vs is used as the absolute value of the voltage level of the scanning signal during selection period T3 and Vd is used as the absolute value of the voltage level of the data signal during selection period T3, the conditions for ON/OFF drive of the liquid crystal are $|Von|=|Vs+Vd|\Delta|Vsat|$ and $|Voff|=|Vs-Vd|\leqq|Vth|$. From a design standpoint, the absolute value of Von must be set larger than the absolute value of Vsat by a certain margin and the absolute value of Voff must be set smaller than the absolute value of Vth within a certain margin, but there is the danger that the margin may become small due to temperature dependency and degrade the display characteristic.

We also found that this threshold value Vth and saturation voltage Vsat deviated within the liquid crystal panel.

If the absolute value $|Vsat-Vth|$ of the difference between the saturation voltage and the threshold voltage is small, it is possible to continually maintain the margin for the ON voltage and the OFF voltage even if the saturation voltage is temperature dependent or there is non-uniformity in the surface.

Figure 17:
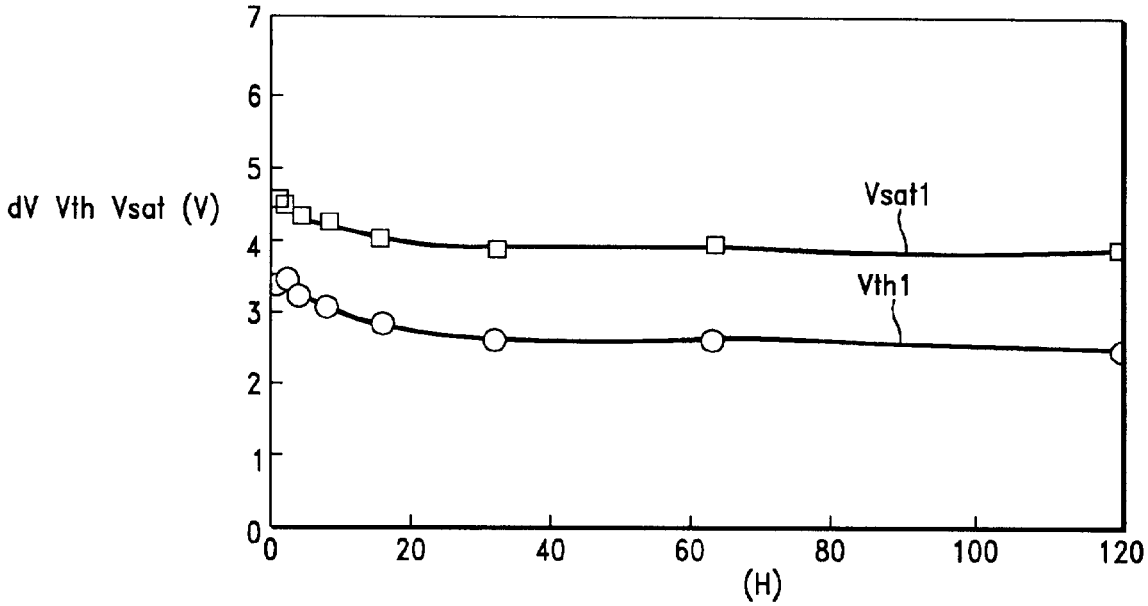
FIG. 17 is a characteristic graph showing experimental results of the relationship of the threshold value and saturation value of the chiral nematic liquid crystal to the reversal time mH.

The inventors discovered that $|Vsat-Vth|$ changes depending on the reversal time mH. FIG. 17, wherein the threshold value Vth and saturation voltage Vsat are plotted on the vertical axis against the reversal time mH on the horizontal axis, shows the mH dependence of the threshold value Vth and saturation voltage Vsat obtained experimentally. Measurements were taken in this experiment with a duty ratio of 1/240, a reset period T1 of 1.5 ms, a reset voltage of ±25 V and a bias voltage of Vd=+1 V.

A better understanding of the dependence of $|Vsat-Vth|$ on reversal time mH can be obtained from the characteristic graphs in FIG. 18 to FIG. 21.

Figure 18:
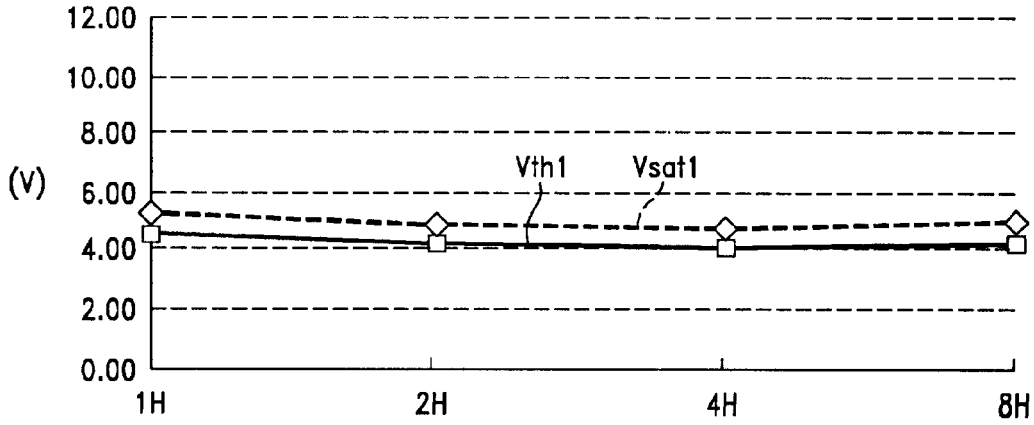
FIG. 18 is a characteristic graph showing other experimental results of the relationship of the threshold value and saturation value of the chiral nematic liquid crystal to the reversal time mH.
Figure 23A:
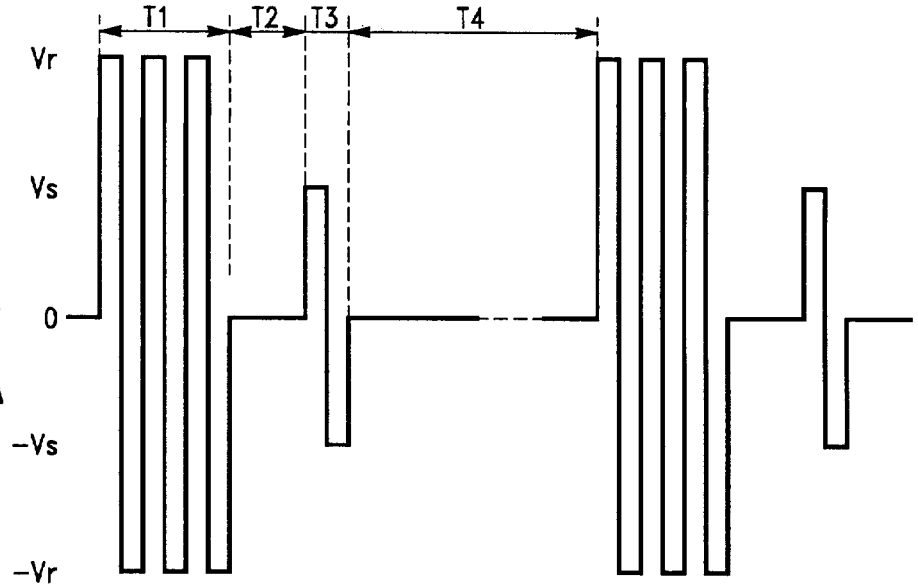
FIGS. 23A–23C are waveform diagrams showing the 7-level drive method.
Figure 23B:
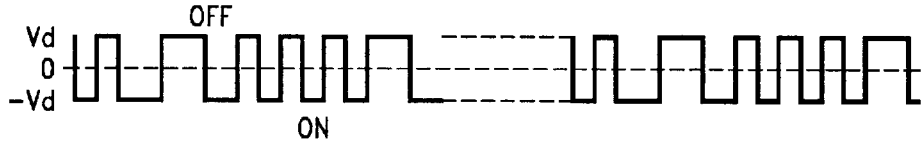
Figure 23C:
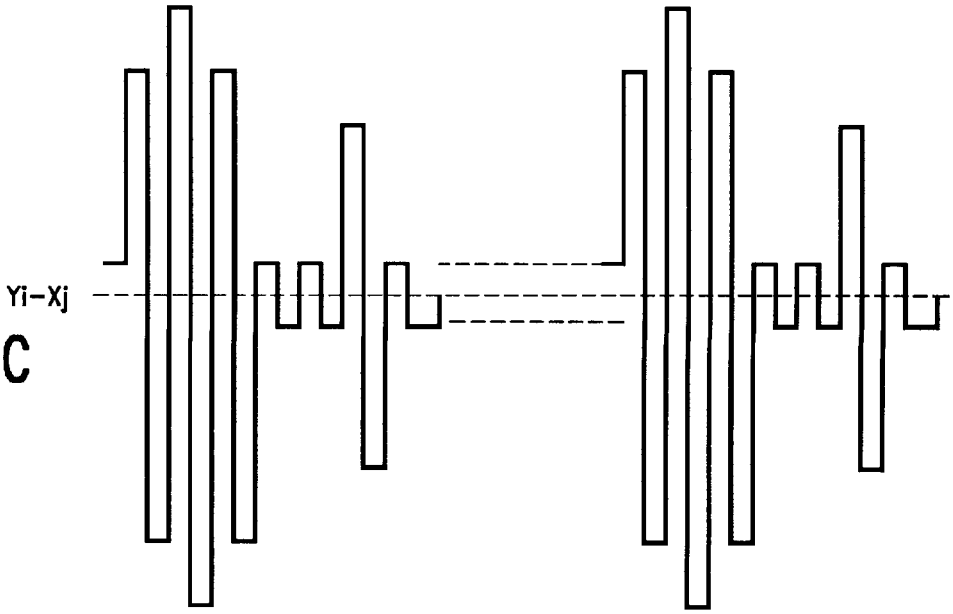

FIG. 18 shows the same experiment as in FIG. 17 wherein mH was varied between 1H and 8H (1H=80 μs). The experimental conditions were duty ratio=1/240, reset period T1=1.0 ms, reset voltage =±25 V and bias voltage Vd=±1.3

V, and measurements were performed at room temperature. According to FIG. 18, Vth1 and the saturation voltage Vsat1 become low between 2H and 4H.

FIG. 19 is a characteristic graph wherein |Vsat−Vth| is plotted on the vertical axis based on the data in FIG. 18, and it can be seen that |Vsat−Vth| drops between 2H and 4H.

FIG. 20 shows the results of the same experiment as in FIG. 19 executed on a liquid crystal panel with a duty ratio of 1/480. Here, 1H=40 $\mu$s. According to FIG. 20, Vth1 and the saturation voltage Vsat1 become low between 4H and 16H.

FIG. 21 is a characteristic graph wherein |Vsat−Vth| is plotted on the vertical axis based on the data in FIG. 20, and it can be seen that |Vsat−Vth| drops between 4H and 16H.

When mH is greater than or equal to 2H as shown here, we found that |Vsat−Vth| can be made small and the ON voltage and OFF voltage can be applied to the liquid crystal under a condition in which a large margin is maintained as compared to when mH=1H, thus improving the display characteristic.

Moreover, when mH is greater than or equal to 2H, the threshold value Vth and saturation voltage Vsat themselves can be made smaller than when compared to mH=1H, thus making it possible to lower the drive voltage.

By means of the drive method in FIG. 2, since a dependence between the reversal time mH and the display characteristic was confirmed, the display characteristic can be improved by the reversal action while also suppressing the continuous application of direct current, which is closely related to the life of the liquid crystal.

Explanation of Drive Waveform in FIG. 5

As in FIG. 2, the method in FIG. 5 uses the FR (see FIG. 5A) of a pulse duration of mH (m=4) and reverses the polarity of the voltage applied to the liquid crystal every mH, but it changes each voltage level of the waveforms of the scanning signal and the data signal.

As shown in FIG. SB, the scanning signal takes on voltages V4, V8 in reset period T1, voltages V2, V7 in delay period T2, voltages V4, VS in selection period T3 and voltages V2, V7 in non-selection period T4.

Figure 5A:
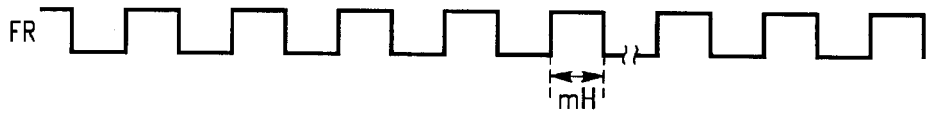
Figure 5B:
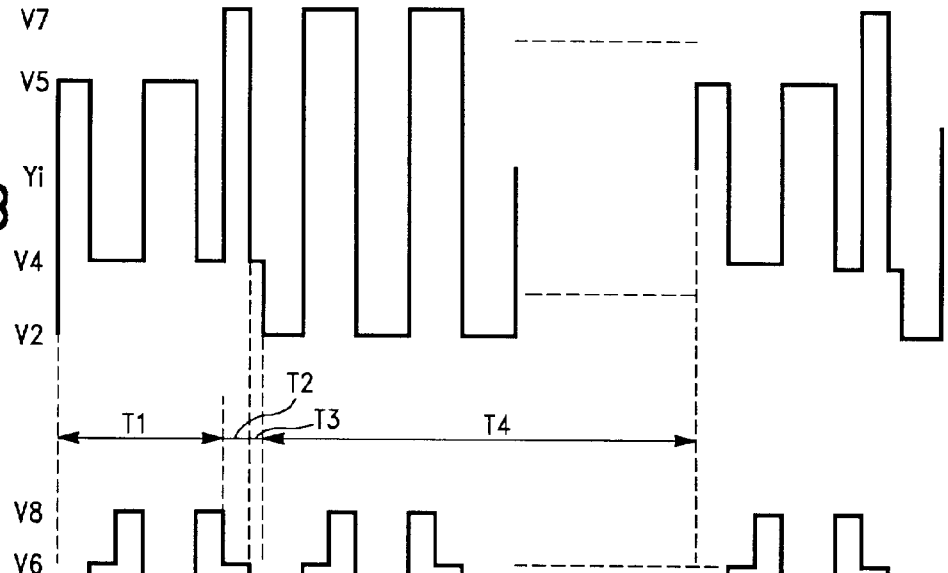
Figure 5C:
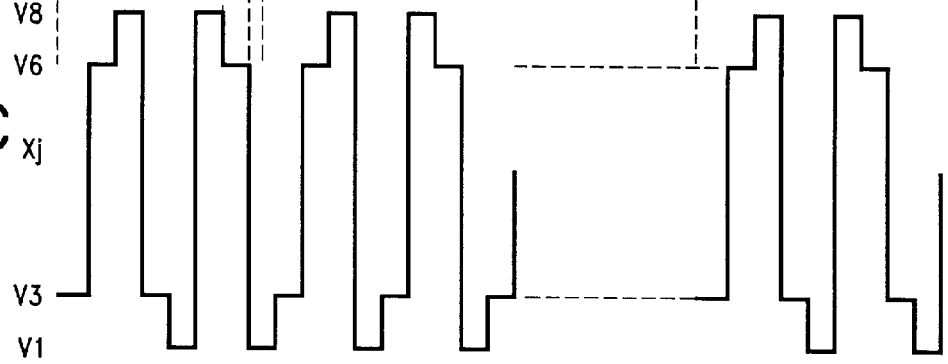

The data signal takes on ON voltages V1, V8 and OFF voltages V3, V6 as shown in FIG. 5C.

Figure 5D:
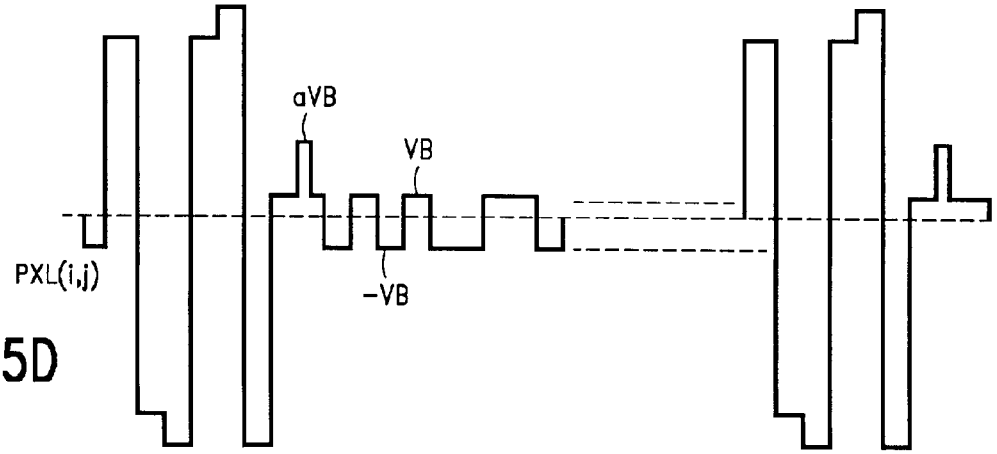

As a result, the voltage applied to the liquid crystal at pixel (i, j) of the matrix display alternates between positive and negative as shown in FIG. 5D. When the drive waveform in FIG. 5 is used, the reset voltage becomes (V4−V8) or (V8−V1) as when V1 to V8 are set the same as the voltage levels in FIG. 2, and though the voltage ±23 V is lower than in FIG. 2, a voltage large enough for reset can be obtained. The other voltages become ON voltage =±3 V, OFF voltage =±1 V and bias voltage =±1 V, which are the same voltages obtained in FIG. 2. Further, since the potential of the data signal can be set to the ground voltage V1 and the maximum voltage V8, the bias voltage becomes stable, thus improving the stability of the display.

In the case of FIG. 5, if V3−V2=V2−V1=V8−V7=V7−V6, the bias voltage in non-selection period T4 can be set so that it is equally applied. Also, as in FIG. 2, the ON voltage can be increased by increasing the voltage difference between V1 and V2 and between V7 and V8. The reset voltage can be increased by increasing the potential difference between V4 and V5. Further, the delay period after application of the reset voltage can be lengthened or shortened by shifting the timing of the selection period in 1H units.

Figures 6A, 6B, 6C, 6D:
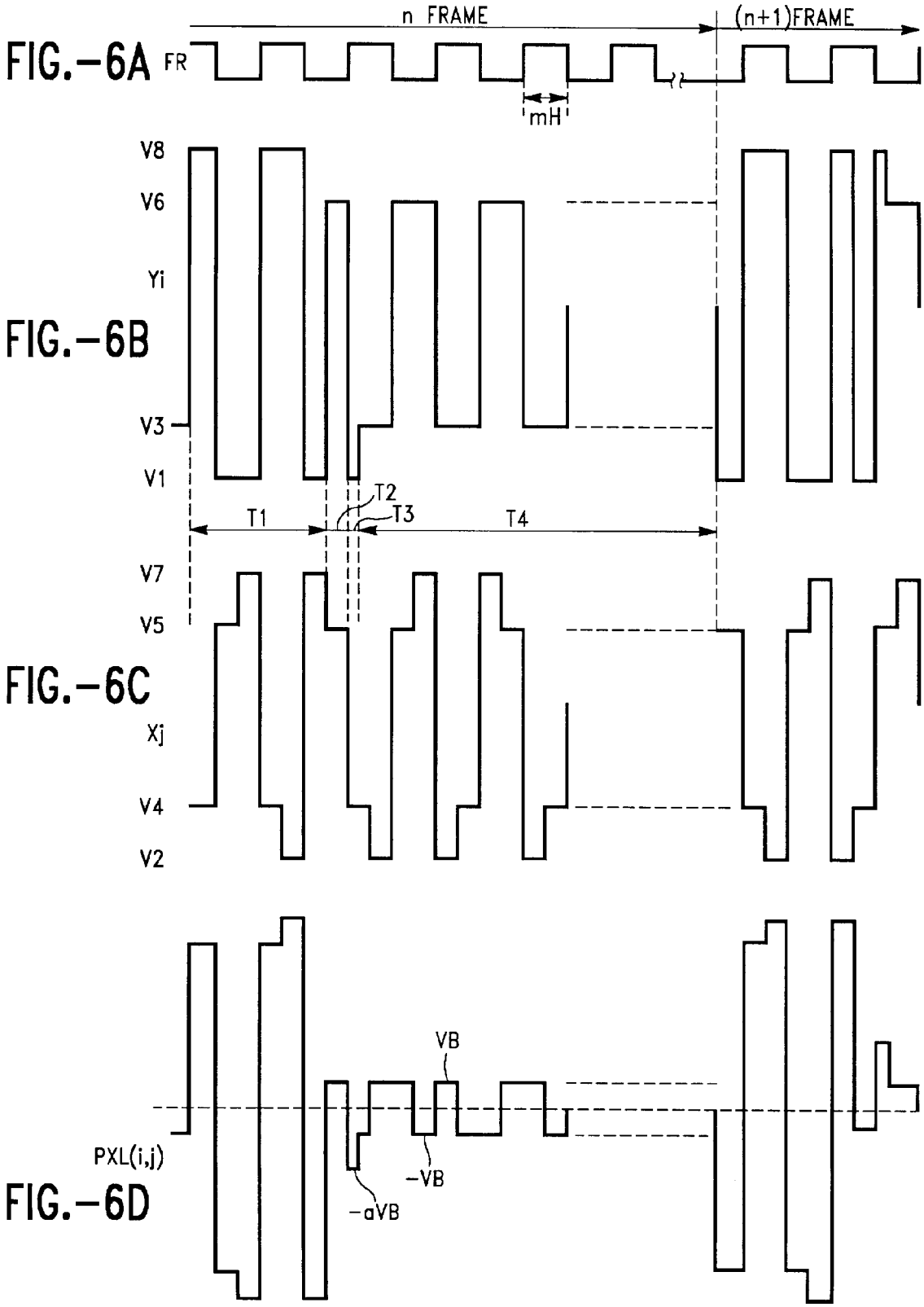
Figure 7A:
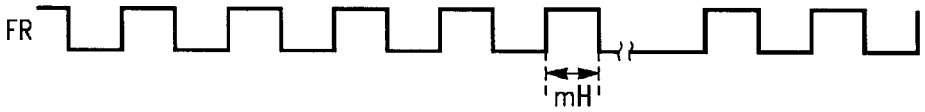
FIGS. 7A–7D are waveform diagram showing yet another drive waveform of the invention wherein frame reversal is added to the drive waveform of FIG. 6A–6D.
Figure 7B:
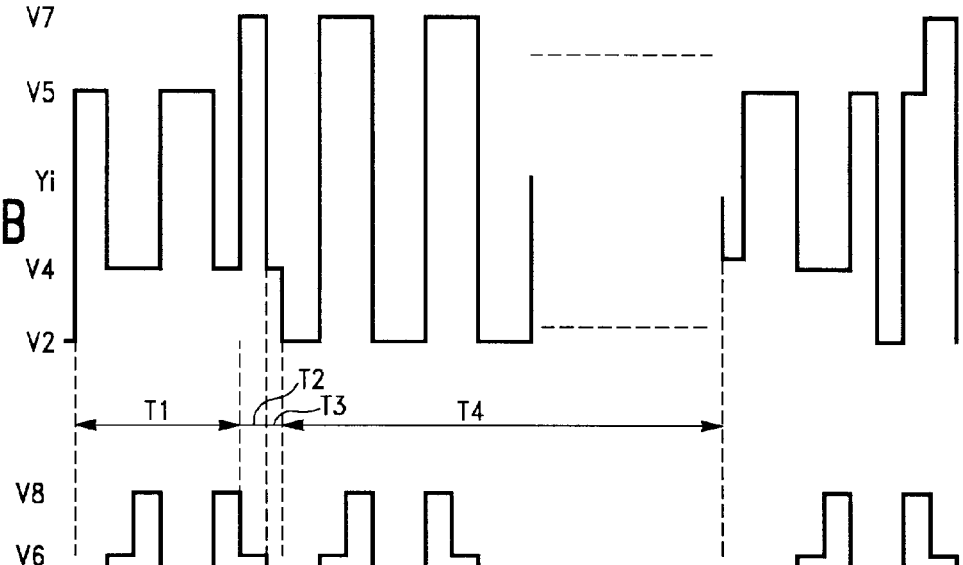
Figure 7C:
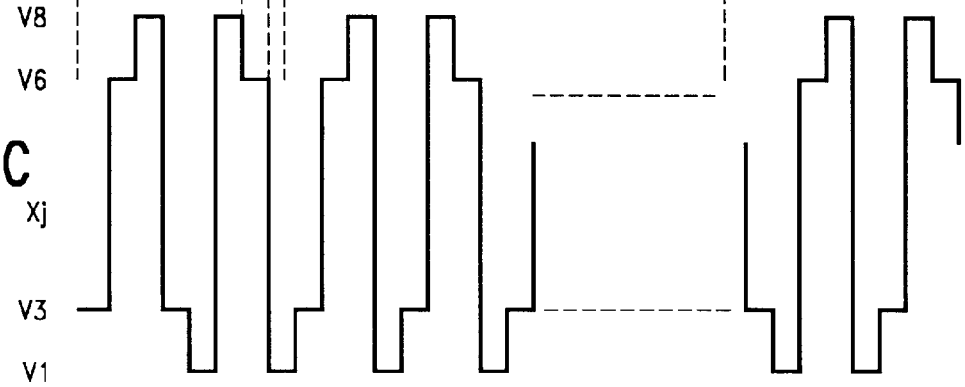
Figure 7D:
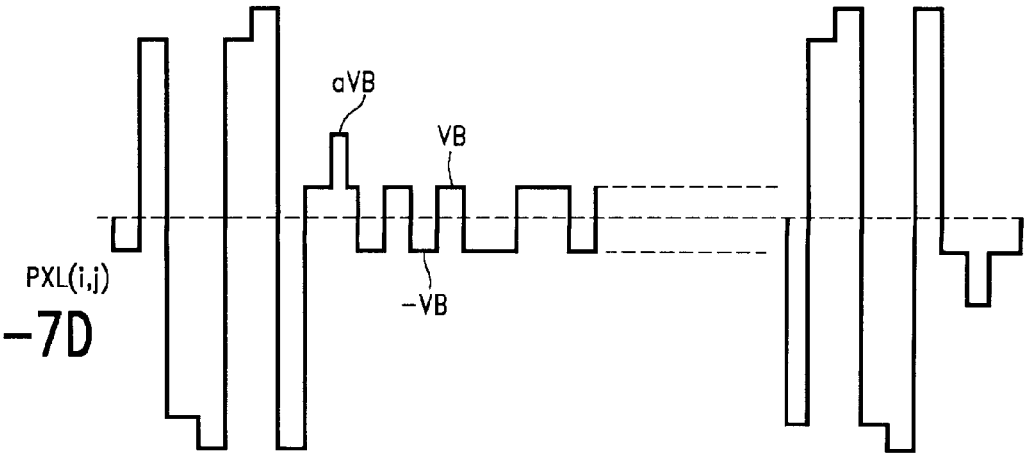

Explanation of Drive Waveform in FIG. 6

FIG. 6 shows a modified embodiment wherein a reversal operation every frame unit overlaps the reversal operation every mH (m=4) as in FIG. 2 and FIG. 5.

That is, when the voltage levels of the scanning signal and the data signal are reversed every mH, the positive and negative components of the voltage applied to the liquid crystal are not balanced within one frame at the end of a frame, and therefore a direct current component remains. To avoid this, the voltage levels of the scanning signal and the data signal in the next frame are reversed from the previous frame, thus reversing voltage levels in frame units. That is, when the voltage at the start of the nth frame (n is an integer) of the drive waveform applied to the liquid crystal is in the first group of voltage levels (V1 to V4), the voltage at the start of the (n+1)th frame is in the second group of voltages (V5 to V8). Also, when the voltage at the start of the nth frame is in the second group, the voltage at the start of the (n+1)th frame is in the first group, thus resulting in overlapping of the reversal every frame unit on the reversal every mH. This can be referred to as a combination of reversal every frame and mH pulse reversal.

By means of the drive waveform in FIG. 6, any direct current component that cannot be resolved in one frame can be completely resolved over two frames, thus greatly contributing to the long life of the liquid crystal.

This embodiment used the same voltage settings as in FIG. 2, but the same voltage settings as the second embodiment in FIG. 5 can also be used. The drive waveform of the drive method in FIG. 5 to which frame reversal has been added is shown in FIG. 7.

Explanation of Liquid Crystal Drive Circuit

Figure 8:
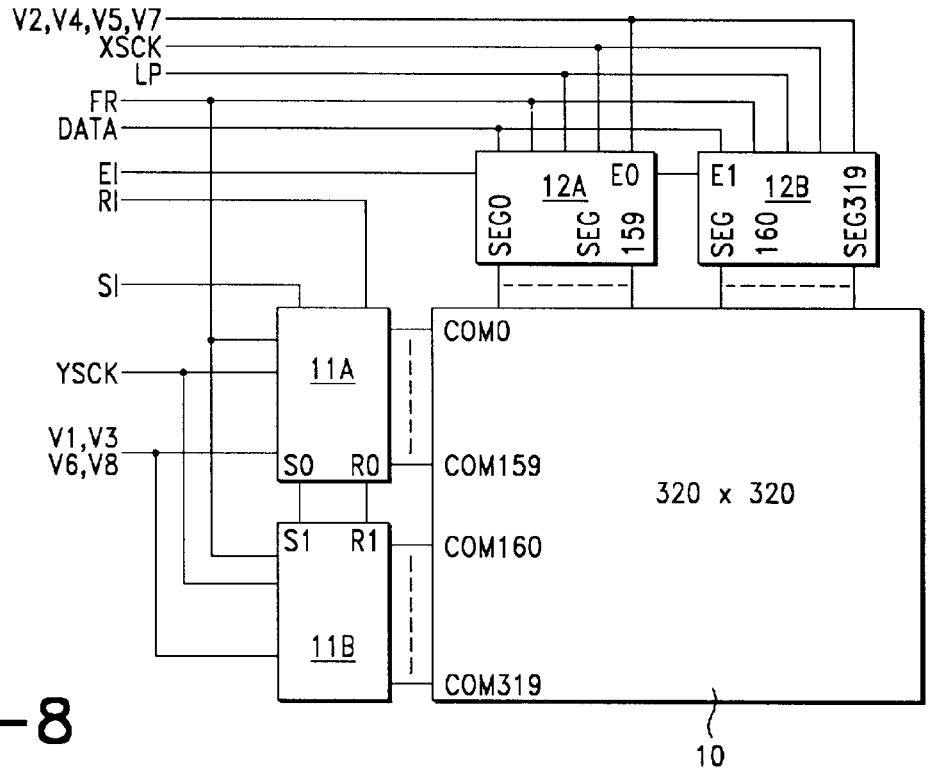
FIG. 8 is a block diagram showing the overall configuration of the matrix liquid crystal drive circuit.

FIGS. 8 to 12 show actual liquid crystal drive circuit configurations and timing charts for realizing the drive waveforms in FIGS. 2, 5, 6 and 7. FIG. 8 is an overall block diagram of the display device including the liquid crystal panel and drive circuit. The liquid crystal panel has 320×320 pixels, and in order to drive this liquid crystal panel 10, first and second Y driver circuits 11A, 11B and first and second X drivers 12A, 12B are provided.

Figure 9:
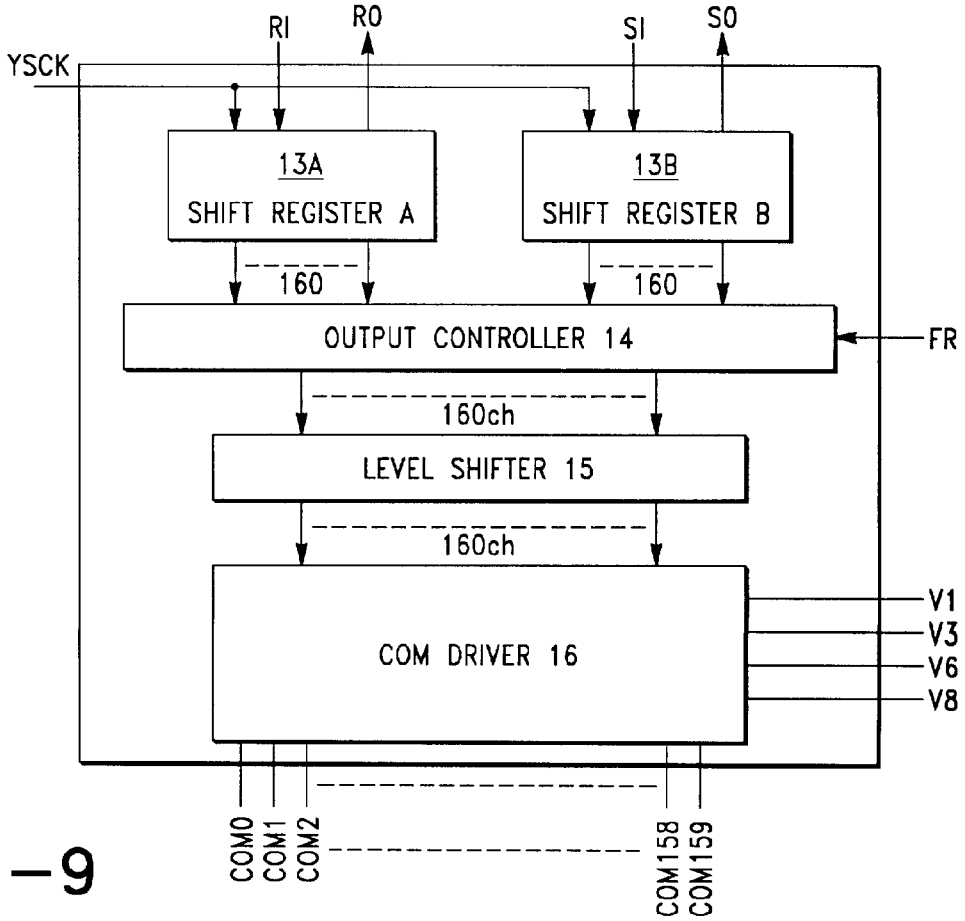
FIG. 9 is a block diagram of the Y driver for generating the scanning signal.

First and second Y driver circuits each have the same configuration, and their detail is shown in FIG. 9.

Y driver circuit 11A is explained by referring to FIG. 9. Y driver circuit 11A has shift register 13A for reset and shift register 13B for selection, both of which are 160-stage registers. Reset signal R1 which specifies reset period T1 is input to register 13A for reset, and this signal is successively shifted to the next-stage register by shift clock YSCK The contents of 160th stage register are output via output terminal R0, and a cascade connection is formed which becomes input R1 of the second Y driver circuit. The same is true for shift register 13B for selection, wherein signal S1 which specifies selection period T3 is input to shift register 13B, and these signals are transmitted one after the other to the next-stage register by the shift clock YSCKY The contents of the final 160th stage register become the input signal S1 of the next second Y driver circuit 11B via output terminal SO, and a cascade connection is formed.

The contents of each shift register 13A, 13B are output in parallel to the 160 channels at the same time and are input to the output controller 14. This output controller 14 outputs a signal that differentiates six states depending on the input state of the reset signal R, the selection signal S and the alternating current signal FR; i.e., R, S, FR=(0, 0, 0) or (0, 0, 1) or (0, 1, 0) or (0, 1, 1) or (1, 0, 0) or (1, 0, 1). This signal is input to Y driver 16 via level shifter 15.

Four types of drive voltages (V1, V3, V6, V8) or (V2, V4, V5, V7) are input to this Y driver 16, and based on the six states differentiated by output controller 14, one each of the drive voltages are output to each channel according to the truth table shown in FIG. 24. In FIG. 24, Yout1 indicates the selection when a drive waveform corresponding to FIGS. 2 and 6 is obtained and Yout2 indicates the selection when a drive waveform corresponding to FIGS. 5 and 7 is obtained.

Figure 11:
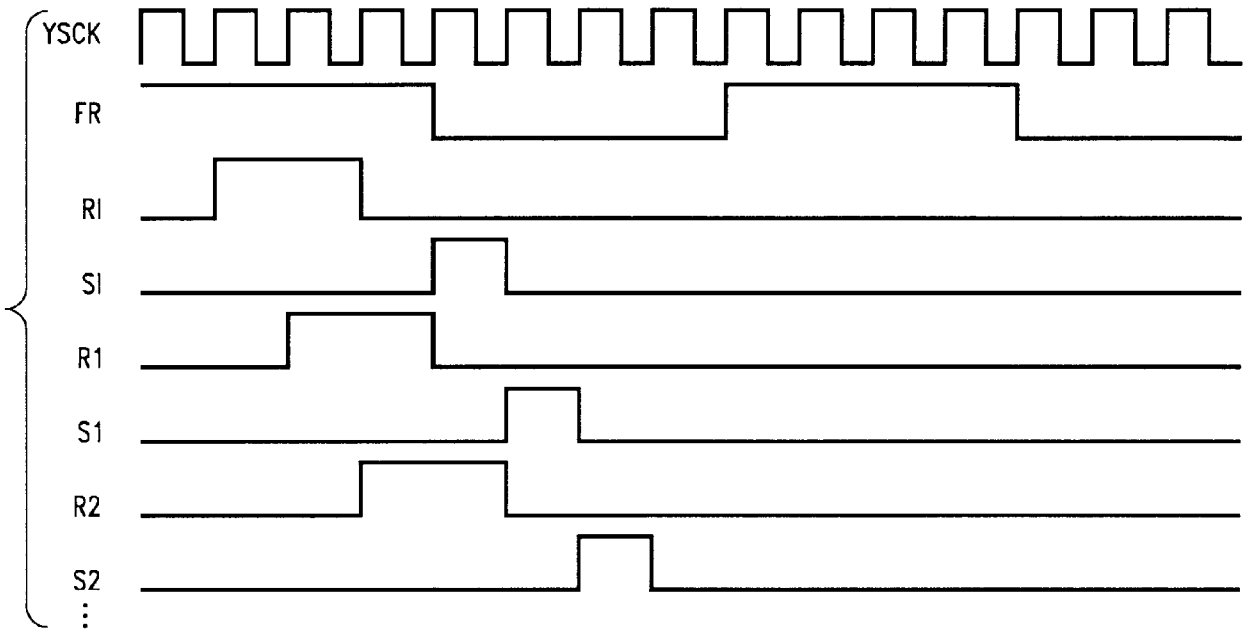
FIG. 11 is a timing chart for explaining the operation of each part of the Y driver.

FIG. 11 is a timing chart showing some of the states of each signal input to the Y drive circuit. In the case of the timing chart shown in FIG. 11, when selection period T3 is 1H long, the shift clock YSCK becomes a signal that repeats HIL every 1H, and since alternating current signal FR is mH, it becomes scanning signal YK whose polarity of the voltage applied to the liquid crystal reverses every mH as in FIGS. 2 and 5.

Figure 10:
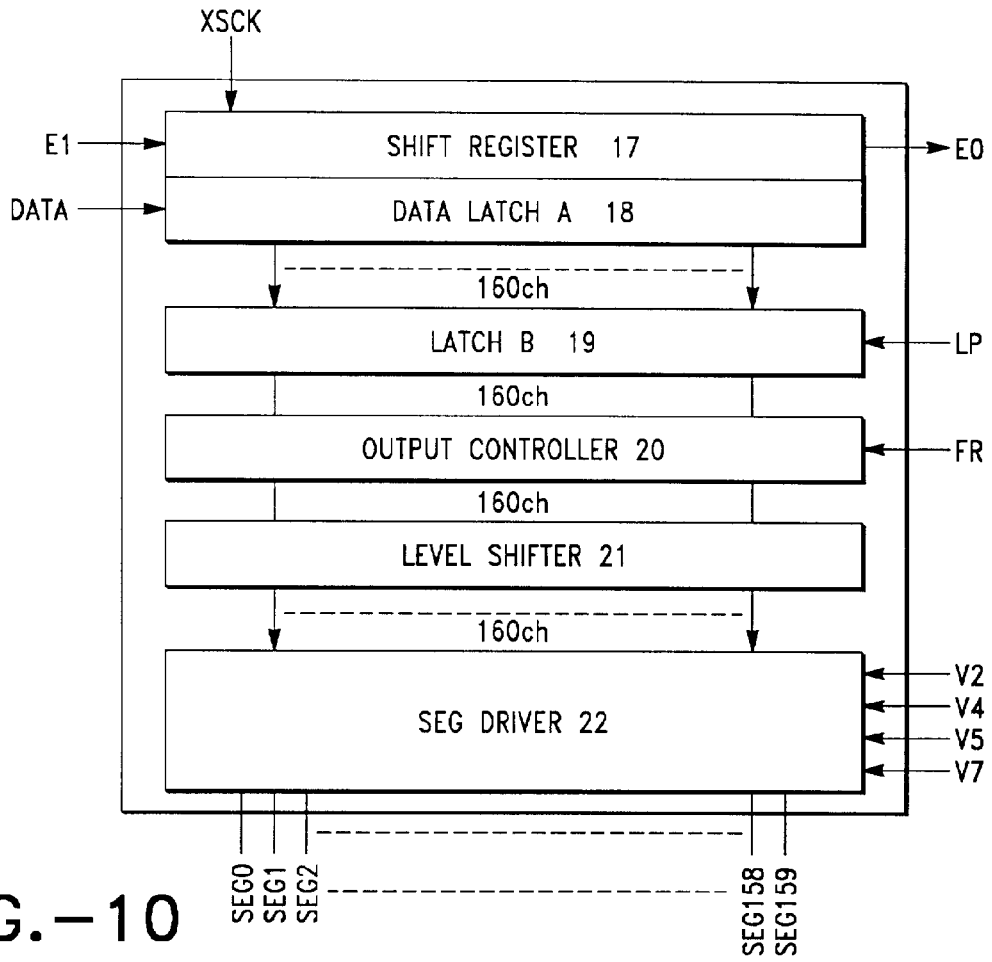
FIG. 10 is a block diagram of the X driver for generating the data scanning signal.
Figure 12:
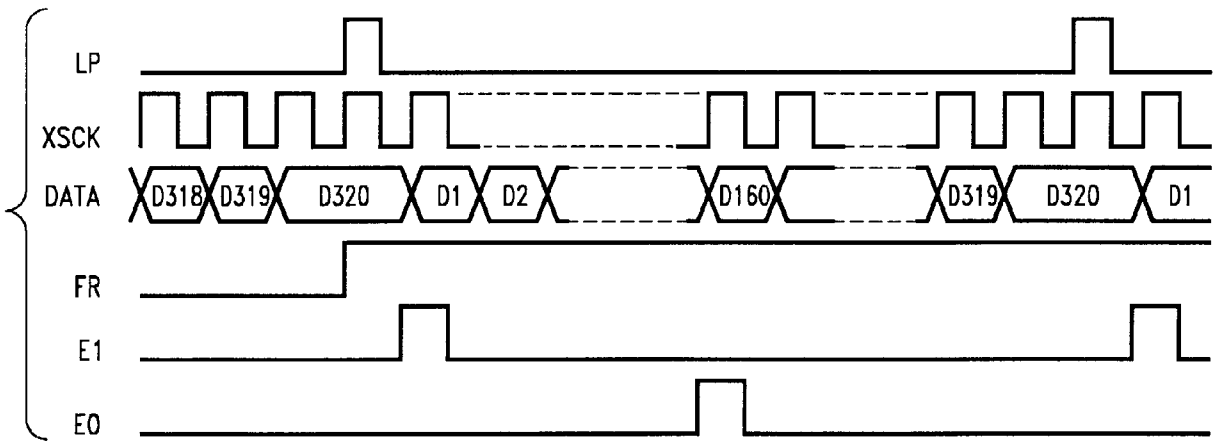
FIG. 12 is a timing chart for explaining the operation of each part of the X driver.

Next is a detailed explanation referring to FIG. 10 of first X driver circuit 12A. X driver circuit 12A has shift register 17 which comprises a 160-stage register, wherein input signal EI is successively shifted to the next stage by shift clock XSCK The contents of the 160th register are output to the outside via the EO output terminal, thus facilitating a cascade connection with second X driver circuit 12B. Signal EI input to shift register 17 is a signal that becomes logical 1 once in one horizontal scanning period (1H) as shown in FIG. 12. Therefore, first latching circuit 18 latches image data into addresses corresponding to the respective registers as logical 1's are successively output from each register of shift register 17. The data of the 160 channels of first latching circuit 18 are latched simultaneously in second latching circuit 19 according to the timing whereby latch pulse LP is input. Output control circuit 20 which inputs alternating current signal FR and the data from second latching circuit 19 inputs a signal that differentiates the four states (D, FR)=(0, 0) or (0, 1) or (1, 0) or (1, 1) depending on the data D and the input state of the alternating current signal FR to X driver 22 for each channel via level shifter 21. X driver 22 inputs four types of drive voltages; i.e., (V2, V4, V5, V7) or (V1, V3, V6, V8), and selects one of these voltages based on information from output control circuit 20 and outputs it. The truth table is shown in FIG. 25. In FIG. 25, Xout1 corresponds to the embodiments in FIGS. 2 and 6 and Xout2 corresponds to the embodiments in FIGS. 5 and 7.

Explanation of Power Supply Circuit

An embodiment of the power supply circuit used in the circuit shown in FIGS. 8 to 12 is explained. In this invention, a total of eight potential levels is used to set each of the voltage levels of the data signal. Of these, V1=GND and V8=maximum reference drive voltage (VH), and each of the remaining potentials V2 to V7 in between need only be determined. In each of the power supply circuits explained below, the drive potentials divided up into the plurality of voltage levels can all be adjusted simultaneously by one control, and therefore they are the simplest possible power supply circuits for optimal adjustment of the display.

First, reference potential difference VB, which becomes the bias voltage in the non-selection period in the voltage averaging method, is defined from Von and Voff of the data signal as shown below and it becomes constant.

$$VB=|Von-Voff|/2$$

Figure 13:
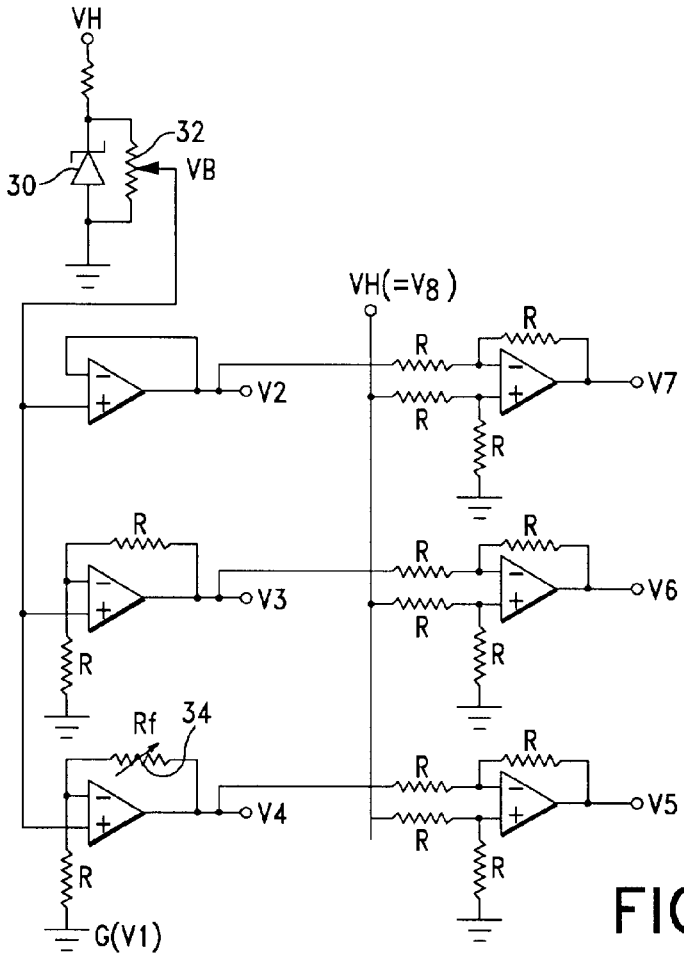
FIG. 13 is a circuit diagram showing an example of the power supply circuit of the invention.

FIG. 13 shows a power supply circuit realized using this reference potential difference VB as a reference.

Since VB need only be several volts, the potential is dropped from VH of a high voltage, for example, via a Zener diode and then the intermediate potential of a variable resistor 32 is extracted as desired from this potential, and this is used as the reference potential difference VB. The required voltages V2, V3 and V4 can be obtained by adding voltages which are VB amplified from 1 to several times to V1, and therefore the positive amplification circuit is configured from an operational amplifier, and V2=V1+VB, V3=V1+VB and V4=V1+aVB (a is the amplification factor). The amplification factor a is determined by feedback resistor 34 of the operational amplifier, which outputs the voltage of V4, and by making this resistance value variable, the amplification factor a can be set as desired.

Next, by configuring the subtraction circuit for these outputs and the maximum potential VH from operational amplifiers such that V7=VH−V2, V6=VH−V3 and V5=VH−V4, a power supply with a fixed bias is realized wherein all voltage levels change by just changing VB. Actually, by inserting a buffer, each voltage level can be amplified by the buffer before it is input to the scanning signal and data signal driver circuits.

This power supply circuit can optimally adjust V4, V5 and it can adjust the ON voltage (V1−V4 or V8−V5) of the embodiments in FIGS. 5 and 7 by changing the amplification factor a. Setting V2, V3 and V4 such that the amplification factor becomes (a−2), (a−1) and a is preferable in the embodiments in FIGS. 2 and 6.

Figure 14:
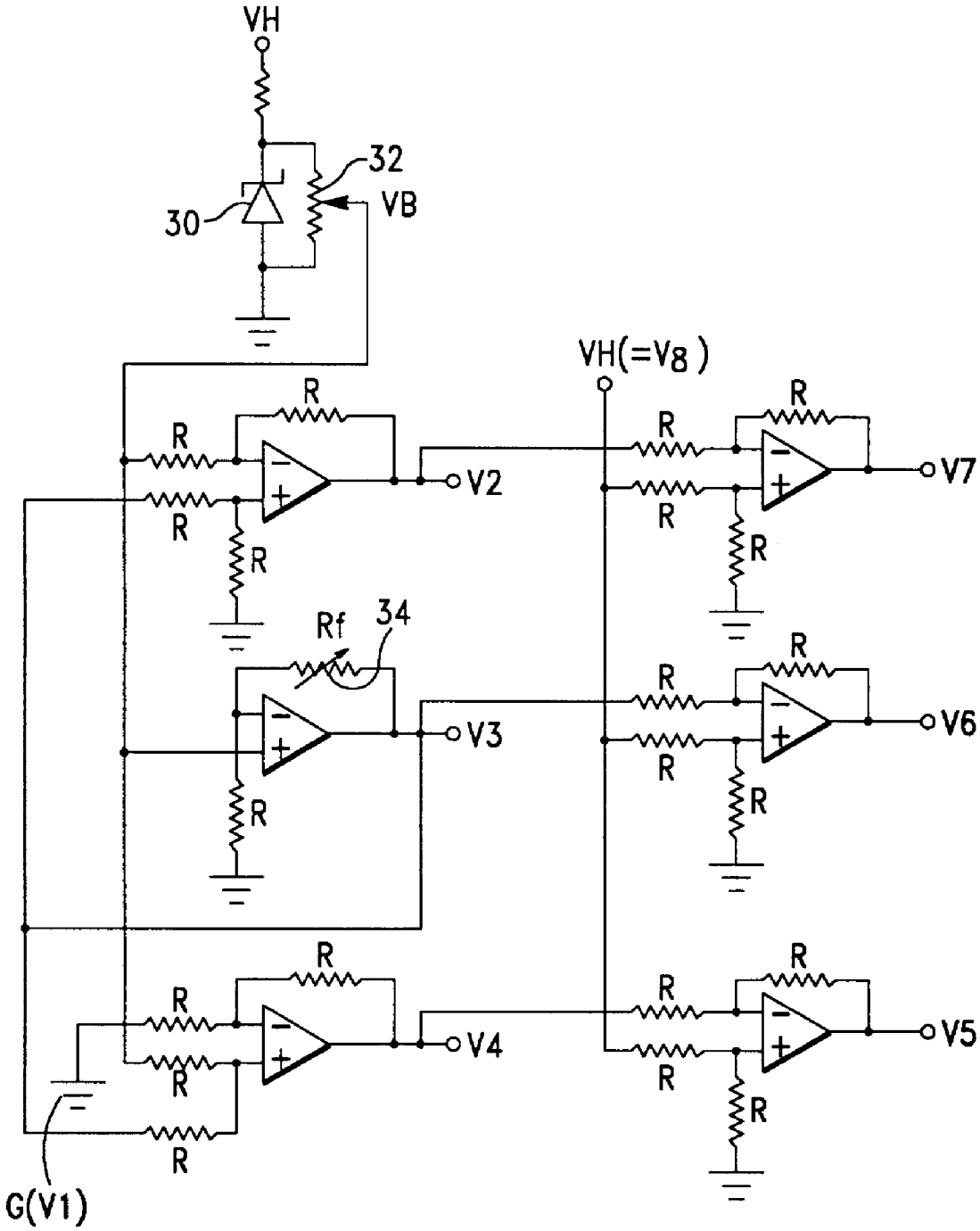
FIG. 14 is a circuit diagram showing an example of another power supply circuit of the invention.

FIG. 14 shows an operation circuit configured from operational amplifiers such that V3=bVB, V2=(b−1)VB and V4=(b+1)VB and which produces the potentials of V2 to V4. However, b is an amplification factor and it is desirable that b be 1 or greater or more preferably 2 or greater. As in FIG. 13, V5 to V7 are produced by subtracting V4, V3 and V2 from VH (V8) in the subtraction circuit configured from operational amplifiers. Here, in FIG. 14, feedback resistor 34 of the operational amplifier that outputs the voltage of V3 is made a variable resistor such that the value of the amplification factor b can be freely changed. As a result, the respective voltage levels of V4 and VS can be adjusted. Therefore, the ON voltage (V1−V4 or V8−V5) of the embodiment in FIG. 6 can be adjusted as desired. In this way, the ON voltage applied to the liquid crystal can be easily controlled, which is also advantageous in drive circuit adjustment.

Figure 15:
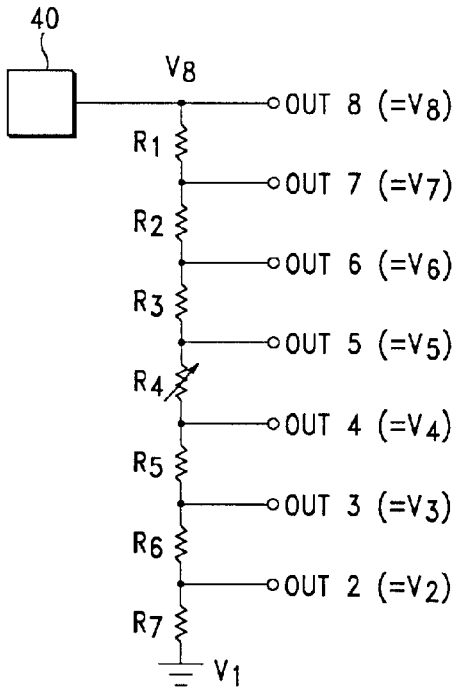
FIG. 15 is a circuit diagram showing yet another example of the power supply circuit of the invention.

FIG. 15 shows yet another power supply circuit of the invention. In the same figure, there are seven resistors (R1, R2, . . . , R7), voltage generation circuit 40, which generates the maximum voltage level V8, is connected to one end of this line, and ground voltage level V1 is connected to the other end. There are also six voltage output terminals OUT7 to OUT2 disposed between adjacent resistors that output the voltage levels V7 to V2 obtained by successively dropping the voltage by means of resistors (R1, R2, . . . , R7). Resistor R4 between voltage output terminal OUTS of VS and voltage output terminal OLTT4 of V4 is a variable resistor, and its resistance can be changed externally.

By changing the resistance of resistor R4 in this power supply circuit, the current flowing through each resistor R1 to R7 can be changed and the extent of the voltage drop can be changed, and therefore, except for ground voltage level Vl and maximum voltage level V8, each voltage level (V2 to V7) can be adjusted simultaneously. By also changing the size of V8 in voltage generation circuit 40, it is possible to change V2 to V8 as desired. In FIG. 14 and FIG. 15, operational amplifiers are connected to OUT2 to OUT7, from which the voltage levels of V2 to V7 are output, for their respective amplification.

This invention is not limited to the above embodiments, and various modifications are possible within the scope of the essentials elements of the invention. For example, in the embodiments shown in FIG. 2 and FIG. 6, if the value m, which determines the reversal time, and number n of scanning lines of the display are set such that there is no maximum common divisor between them, the reversal position shifts naturally and it is possible to prevent any waveform rounding or crosstalk due to reversal from becoming pronounced. Also, if m is set appropriately large, the crosstalk positions generated by voltage reversal are reduced.

What is claimed is:

1. A drive method for a liquid crystal display device comprising:

applying a voltage difference between a data signal and a scanning signal on a chiral nematic liquid crystal having at least two stable states, said scanning signal having at least a reset period, a selection period and a non-selection period in one frame;

providing a total of eight or more voltage levels made up of a plurality of levels of a first group on a low voltage side and a plurality of levels of a second group on a high voltage side;

alternating voltage levels of said scanning signal and said data signal between said first group and second group every mH where, m is an integer that is 2 or greater and mH≠1 frame period, and wherein mH is an integral multiple of a unit time (1H) equivalent to said selection period of said scanning signal;

selecting a voltage level of said reset period in said scanning signal from said second group when said data signal is a voltage level of said first group, and selecting a voltage level of said reset period in said scanning signal from said first group when said data signal is a voltage level of said second group;

selecting voltage levels of each of said selection period and non-selection period in said scanning signal from said first group when said data signal is a voltage level of said first group, and selecting voltage levels of each of said selection period and non-selection period in said scanning signal from said second group; when said data signal is a voltage level of said second group and reversing the polarity of the voltage applied to said liquid crystal every mH.

2. A drive method for a liquid crystal display device as in claim 1 wherein:

the absolute value of the voltage difference of a saturation voltage Vsat and a threshold voltage Vth of the chiral nematic liquid crystal changes with the value of m and further comprising selecting the value of m such that the absolute value of said voltage difference is small.

3. A drive method for a liquid crystal display device as in claim 2 further comprising:

setting the absolute value of the ON voltage applied to the chiral nematic liquid crystal in said selection period larger than the absolute value of said saturation voltage Vsat of the chiral nematic liquid crystal by at least an allowable margin and setting the absolute value of the OFF voltage applied to the chiral nematic liquid crystal in said selection period smaller than the absolute value of said threshold voltage Vth of the chiral nematic liquid crystal within an allowable margin.

4. A drive method for a liquid crystal display device as in one of claims 1 to 3 further comprising:

providing a delay period in said scanning signal between said reset period and said selection period, and setting the voltage level in said delay period of said scanning signal the same as the voltage level of said non-selection period.

5. A drive method for a liquid crystal display device as in one of claims 1 to 3 further comprising:

setting said data signal every said selection period to a data voltage level containing the voltage level of either the ON voltage level or the OFF voltage level and setting four voltage levels for application of positive and negative ON selection voltages and positive and negative OFF selection voltages to said liquid crystal as said data voltage levels of said data signal, and setting said scanning signal to the reset voltage level in said reset period, to the selection voltage level in said selection period, and to the non-selection voltage level in said non-selection period, setting two types of voltage levels for application of positive and negative reset voltages to said liquid crystal as said reset voltage levels in said reset period, setting two types of voltage levels for application of said positive and negative selection voltages to said liquid crystal as said selection voltage levels in said selection period, and setting two types of voltage levels to provide bias voltage levels as said non-selection voltage levels in said non-selection period, and driving said liquid crystal using a total of eight voltage levels by using said two types of reset voltage levels and said two types of selection voltage levels in common.

6. A drive method for a liquid crystal display device as in claim 5 wherein:

said eight voltage levels comprise [the] four levels (V1, V2, V3, V4; V1<V2<V3<V4) of a first group on the low-voltage side including ground voltage level V1 and four levels (V5, V6, V7, V8; V4<V5<V6<V7<V8) of a second group on the high-voltage side.

7. A drive method for a liquid crystal display device as in claim 6 wherein:

said scanning signal takes on a waveform having the voltage level of V1 and V8 in said reset period, takes on the voltage level of V1 or V8 in said selection period, and takes on a waveform having the voltage level of V3 and V6 in said non-selection period, and said data signal is a waveform including a pulse whose peak value changes to the voltage level of V2 and V4 and a pulse whose peak value changes to the voltage levels of VS and V7.

8. A drive method for a liquid crystal display device as in claim 7 further comprising:

setting the relationship V4−V3=V3−V2=V7−V6=V6−V8.

9. A drive method for a liquid crystal display device as in claim 6 wherein:

said scanning signal takes on a waveform having the voltage levels of V4 and V8 in said reset period, takes on the voltage levels of V4 or V5 in said selection period, and takes on a waveform having the voltage levels of V2 and V7 in said non-selection period, and said data signal is a waveform including a pulse whose peak value changes to the voltage levels of V1 and V3 and a pulse whose peak value changes to the voltage levels of V6 and V8.

10. A drive method for a liquid crystal display device as in claim 9 further comprising:

setting the relationship V3−V2=V2−V1=V8−V7=V7−V6.

11. A drive method for a liquid crystal display device as in one of claims 1 to 3 wherein:

the value m which determines the reversal time is set to a value such that the value resulting from dividing the number of display scanning lines by m is an integer.

12. A drive method for a liquid crystal display device as in one of claims 1 to 3 wherein:

the value m which determines the reversal time is set to a value such that the value resulting from dividing the number of display scanning lines by m is not an integer.

13. A drive method for a liquid crystal display device as in one of claims 1 to 3 further comprising:

setting mH<1 frame period, and setting the start of the (n+1)th frame to a voltage level of the second group when the voltage at the start of the nth frame is a voltage level of said first group and wherein n is an integer, setting the start of the (n+1)th frame to a voltage level of the first group when the voltage at the start of the nth frame is a voltage level of said second group, and overlapping and repeating reversal every mH and reversal every frame unit.

14. A drive method for a liquid crystal display device as in claim 7 further comprising:

setting mH<1 frame period and, in the nth frame where n is an integer, setting the ON selection voltage level of said data signal to V4 of the first group and setting the OFF selection voltage level to V2 of the first group, and setting said reset voltage level at the start of said scanning signal to V8 and setting said selection voltage level to V1, and in the following (n+1)th frame, setting the ON selection voltage level of said data signal to V5 of said second group and setting the OFF selection voltage level to V7 of the second group, and setting said reset voltage level at the start of said scanning signal to V1 and setting said selection voltage level to V8, and overlapping and repeating reversal every mH and reversal every frame unit.

15. A drive method for a liquid crystal display device as in claim 9 further comprising:

setting mH<1 frame period, and in the nth frame, where n is an integer, setting the ON selection voltage level of said data signal to V1 of said first group and setting the OFF selection voltage level to V3 of the first group, and setting said reset voltage level at the start of said scanning signal to V5 and setting said selection voltage level to V4, and in the following (n+1)th frame, setting the ON selection voltage level of said data signal to V8 of the second group and setting the OFF selection voltage level to V6 of the second group, and setting said reset voltage level at the start of said data signal to V4 and setting said selection voltage level to V5, and overlapping and repeating reversal every mH and reversal every frame unit.

16. A drive method for a liquid crystal display device as in claim 6 wherein:

the voltage level difference between voltage level V4 of said first group and voltage level V5 of said second group is made large and the absolute value of said reset voltage applied to said liquid crystal in said reset period is set large.

17. A liquid crystal display device comprising;

a liquid crystal panel made up of chiral nematic liquid crystal having at least two stable states and infused between a first substrate whereon are formed a plurality of scanning electrodes and a second substrate whereon are formed a plurality of data electrodes;

a scanning electrode drive circuit that outputs scanning signals having at least a reset period, a selection period and a non-selection period in one frame to each of said scanning electrodes;

a data electrode drive circuit that outputs data signals to each of said data electrodes; and a power supply circuit that outputs a total of eight or more voltage levels made up of a plurality of levels of a first group on a low-voltage side and a plurality of levels of a second group on a high-voltage side as potentials of said scanning signal and said data signal; and wherein said scanning electrode drive circuit and said data electrode drive circuit comprise means for alternately changing the voltage levels of said scanning signal and said data signal between said first group and second group every mH where, m is an integer that is 2 or greater and mH g 1 frame period, and wherein mH is an integral multiple of the unit time (1H) equivalent to said selection period of said scanning signal; and said scanning electrode drive circuit further comprises means for selecting the voltage level of said reset period in said scanning signal from said second group when said data signal is a voltage level of said first group and selecting the voltage level of said reset period in said scanning signal from said first group when said data signal is a voltage level of said second group, selecting each of the voltage levels of said selection period and non-selection period in said scanning signal from said first group when said data signal is a voltage level of said first group and selecting each of the voltage levels of said selection period and non-selection period in said scanning signal from said second group when said data signal is a voltage level of said second group, and reversing the polarity of the voltage applied to said liquid crystal every mH.

18. A drive circuit for a liquid crystal display device that drives said liquid crystal and is connected to:

a liquid crystal panel comprising chiral nematic liquid crystal having at least two stable states and infused between a first substrate whereon are formed a plurality of scanning electrodes and a second substrate whereon are formed a plurality of data electrodes, and a power supply circuit that outputs a total of eight or more voltage levels made up of a plurality of levels of a first group on a low-voltage side and a plurality of levels of a second group on a high-voltage side as drive potentials for said liquid crystal, said drive circuit comprising:

a scanning electrode drive circuit that outputs scanning signals having at least a reset period, a selection period and a non-selection period in one frame to each of said scanning electrodes; and a data electrode drive circuit that outputs data signals to each of said data electrodes; wherein said scanning electrode drive circuit and said data electrode drive circuit comprise means for alternately changing the voltage levels of said scanning signal and said data signal between said first group and second group every mH where, m is an integer that is 2 or greater and mH≠1 frame period, and wherein mH is an integral multiple of the unit time (1H) equivalent to said selection period of said scanning signal; and said scanning electrode drive circuit further comprises means for selecting the voltage level of said reset period in said scanning signal from said second group when said data signal is a voltage level of said first group and selecting the voltage level of said reset period in said scanning signal from said first group when said data signal is a voltage level of said second group, selecting each of the voltage levels of said selection period and non-selection period in said scanning signal from said first group when said data signal is a voltage level of said first group and selecting each of the voltage levels of said selection period and non-selection period in said scanning signal from said second group when said data signal is a voltage level of said second group, and reversing the polarity of the voltage applied to said liquid crystal every mH.

19. A Rower supply circuit device for a liquid crystal display device, which generates an even number of a total of 8 or more voltage levels (V1, V2, . . . , $V_{k/2}$, . . . ,$V_{k-1}$, $V_k$; V1<V2< . . . <$V_{k/2}$< . . . <$V_{k-1}$<$V_k$), including a ground voltage level V1, for applying a voltage of a difference signal of a scanning signal and a data signal to the liquid crystal, comprising:

means for generating a maximum voltage level $V_k$;

means for generating a potential difference $V_B$, which becomes a reference for generating voltage levels V2 to $V_{k-1}$, not including the maximum voltage level $V_k$ and ground voltage level V1;

calculation means for calculating and outputting voltage levels V2 to $V_{k-1}$ based on said potential difference $V_B$; and changing means for changing the value of said potential difference $V_B$ externally to adjust each voltage level (V2, . . . , $V_{k-1}$) simultaneously except said ground voltage level V1 and said maximum voltage level $V_k$.

20. A power supply circuit device for a liquid crystal display device as in claim 19 wherein:

said means for generating said potential difference $V_B$ generates said potential difference $V_B$ based on said maximum voltage level $V_k$.

21. A power supply circuit device for a liquid crystal display device as in claim 19 or 20 wherein:

said calculation means comprises:

a plurality of calculation circuits to which said voltage level $V_B$ is input and that calculate and output each of the voltage levels (V2, . . . , $V_{k/2}$) from among the plurality of levels (V1, V2, . . . , $V_{k/2}$), except said ground voltage level V1, of a first group on a low-voltage side of said eight or more voltage levels, and a plurality of subtraction circuits that generate each of the voltage levels ($V_{k-1}$, . . . , $V_{k/2+1}$) of the voltage levels ($V_{k/2+1}$, $V_{k/2+2}$, . . . , $V_{k-1}$, $V_k$), except said maximum voltage level $V_k$, of a second group on a high voltage side by subtracting the respective outputs (V2, . . . , $V_{k/2}$) of said calculation means from said maximum voltage level $V_k$.

22. A Rower supply circuit device for a liquid crystal display device, which generates a total of 8 or more voltage levels (V1, V2, . . . , V7, V8; V1<V2< . . . <V7<V8), including a ground voltage level V1, for applying a voltage of a difference signal of a scanning signal and a data signal to a chiral nematic liquid crystal having at least two stable states, comprising:

means for generating a maximum voltage level V8;

means for generating a potential difference VB, which becomes a reference for generating voltage levels V2 to V7, not including said maximum voltage level V8 and said ground voltage level V1;

a calculation means for calculating and outputting voltage levels V2 to V7 based on said potential difference $V_B$; and changing means for changing the value of said potential difference $V_B$ externally to adjust each voltage level (V2, . . . , V7) simultaneously, except said ground voltage level V1 and maximum voltage level V8.

23. A power supply circuit device for a liquid crystal display device as in claim 22 wherein:

said means for generating said potential difference $V_B$ generates said potential difference $V_B$ based on said maximum voltage level V8.

24. A power supply circuit device for a liquid crystal display device as in claim 22 or 23 wherein:

said calculation means comprises a plurality of calculation circuits to which said voltage level $V_B$ is input and that calculate and output each of the voltage levels (V2, V3, V4) from among the plurality of levels (V1, V2, V3, V4), except said ground voltage level V1, of a first group on a low-voltage side of said eight or more voltage levels, and a plurality of subtraction circuits that generate each of the voltage levels (V5, V6, V7) of the voltage levels (V5, V6, V7, V8), said except maximum voltage level V8, of a second group on a high voltage side by subtracting the respective outputs (V2, V3, V4) of said calculation means from said maximum voltage level V8.

25. A power supply circuit device for a liquid crystal display device of one of claims 19, 20, 22 or 23 including means for setting said potential difference level $V_B$ to $V_B$=|Von−Voff|/2 determined from Von and Voff of said data signal.

26. A liquid crystal display device comprising.

a liquid crystal panel made up of chiral nematic liquid crystal having at least two stable states and infused between a first substrate whereon are formed a plurality of scanning electrodes and a second substrate whereon are formed a plurality of data electrodes;

a power supply circuit that generates an even number of a total of 8 or more voltage levels (V1, V2, . . . , $V_{k/2}$, . . . , $V_{k-1}$, $V_k$; V1<V2< . . . <$V_{k/2}$< . . . <$V_{k-1}$<$V_k$), including a ground voltage level V1;

a drive circuit to which is input said voltage levels from said power supply circuit and which drives said liquid crystal by outputting a scanning signal to said scanning electrodes and outputting a data signal to said data electrodes of said liquid crystal panel; and wherein said drive circuit comprises means for generating a maximum voltage level $V_k$, means for generating a potential difference $V_B$, which becomes a reference for generating voltage levels V2 to $V_{k-1}$, except said maximum voltage level $V_k$ and said ground voltage level V1, calculation means for calculating voltage levels V2 to $V_{k-1}$ based on said potential difference $V_B$, and changing means for changing the value of said potential difference VB externally to adjust each voltage level (V2, . . . , $V_{k-1}$) simultaneously except said ground voltage level V1 and maximum voltage level $V_k$.

27. A power supply circuit device of a liquid crystal display device, which generates a total of 8 or more voltage levels (V1, V2, . . . ,$V_{k/2}$, . . . ,$V_{k-1}$, $V_k$; V1<V2< . . . <$V_{k/2}$< . . . <$V_{k-1}$<$V_k$), including a ground voltage level V1, for applying a voltage of a difference signal of a scanning signal and a data signal to the liquid crystal, comprising means for generating a maximum voltage level $V_k$;

(k-1) resistors (R1, R2, . . . , $R_{k-1}$) connected in order from one end and in series to a path whose voltage at one end is said maximum voltage level $V_k$ and whose voltage at the other end is ground voltage level V1;

(k-2) voltage output terminals each connected between two adjacent resistors and that output said voltage levels $V_{k-2}$ to V2 obtained by sequentially dropping the voltage via said resistors (R1, R2, . . . , $R_{k-1}$); and means for changing the resistance value of one of said (k-1) resistors externally to adjust each voltage level (V2 to $V_{k-1}$) simultaneously, except said ground voltage level V1 and maximum voltage level $V_k$.

28. A power supply circuit device of a liquid crystal display device, which generates a total of 8 voltage levels (V1, V2, . . . , V7, V8; V1<V2< . . . <V7<V8), including a ground voltage level V1, for applying a voltage of a difference signal of a scanning signal and a data signal to a chiral nematic liquid crystal having at least two stable states, comprising:

means for generating a maximum voltage level V8;

seven resistors (R1, R2, . . . , R7) connected in order from one end and in series to a path whose voltage at one end is said maximum voltage level V8 and whose voltage at the other end is the ground voltage level V1;

six voltage output terminals each connected between two adjacent resistors and that output said voltage levels V7 to V2 obtained by sequentially dropping the voltage via said resistors (R1, R2, . . . , R7); and means for changing the resistance value of said resistor R4 between said voltage output terminal of V5 and said voltage output terminal of V4 externally to adjust each voltage level (V2 to V7) simultaneously, except said ground voltage level V1 and maximum voltage level V8.

29. A liquid crystal display device comprising:

a liquid crystal panel comprising chiral nematic liquid crystal having at least two stable states and infused between a first substrate whereon are formed a plurality of scanning electrodes and a second substrate whereon are formed a plurality of data electrodes;

a power supply circuit that generates an even number of a total of 8 or more voltage levels (V1, V2, . . . , $V_{k/2}$, . . . , $V_{k-1}$, $V_k$; V1<V2< . . . . <$V_{k/2}$ . . . <$V_{k-1}$< $V_k$), including a ground voltage level V1;

a drive circuit to which is input said voltage levels from said power supply circuit and which drives said liquid crystal by outputting a scanning signal to said scanning electrodes and outputting a data signal to said data electrodes of said liquid crystal panel; and wherein said drive circuit comprises means for generating a maximum voltage level $V_k$, (k-1) resistors (R1, R2, . . . , $R_{k-1}$) connected in order from one end and in series to a path whose voltage at one end is said maximum voltage level $V_k$ and whose voltage at the other end is said ground voltage level $V_1$, (k-2) voltage output terminals each connected between two adjacent resistors and that output said voltage levels $V_{k-2}$ to V2 obtained by sequentially dropping the voltage via said resistors (R1, R2, . . . , $R_{k-1}$), and means for changing the resistance value of one of said (k-1) resistors externally to adjust each voltage level (V2 to $V_{k-1}$) simultaneously except said ground voltage level V1 and maximum voltage level $V_k$.

* * * * *

UNITED STATES PATENT AND TRADEMARK OFFICE

CERTIFICATE OF CORRECTION

PATENT NO. : 6,252,571 B1
DATED : June 26, 2001
INVENTOR(S) : Hiroaki Nomura et al.

It is certified that error appears in the above-identified patent and that said Letters Patent is hereby corrected as shown below:

Column 17,
Lines 45, 52 and 63, delete ":".

Column 18,
Lines 2, 28, 35, 46, 50, 61 and 65, delete ":"
Line 29, delete "[the]"
Line 44, change "VS" to -- V5 --
Lines 48 and 52, change "V8" to -- V5 --

Column 19,
Lines 5, 10, 21, 38 and 55, delete ":" and
Line 22, insert -- , -- after "frame"

Column 20,
Line 17, change "mH g 1" to -- mH ≠ 1 -- and
Line 39, delete ":".

Column 21,
Lines 17 and 57, change "Rower" to -- power --
Line 34, insert -- , -- after "simultaneously"
Lines 37 and 42, delete ":"
Line 49, change "levels," to -- levels; --.

UNITED STATES PATENT AND TRADEMARK OFFICE

CERTIFICATE OF CORRECTION

PATENT NO. : 6,252,571 B1
DATED : June 26, 2001
INVENTOR(S) : Hiroaki Nomura et al.

It is certified that error appears in the above-identified patent and that said Letters Patent is hereby corrected as shown below:

Column 22,
Lines 11 and 16, delete ":"
Line 35, change "." to -- : -- and
Line 60, insert -- , -- after "simultaneously".

Column 23,
Line 2, insert -- : -- after "comprising".

Signed and Sealed this

Twenty-sixth Day of March, 2002

*Attest:*

*Attesting Officer*

JAMES E. ROGAN
*Director of the United States Patent and Trademark Office*